US009457260B2

(12) United States Patent
Weber

(10) Patent No.: US 9,457,260 B2
(45) Date of Patent: Oct. 4, 2016

(54) SKATEBOARD TRUCK SYSTEM AND METHOD

(71) Applicant: Custom Trucks, LLC, Houston, TX (US)

(72) Inventor: Derek Weber, Houston, TX (US)

( * ) Notice: Subject to any disclaimer, the term of this patent is extended or adjusted under 35 U.S.C. 154(b) by 0 days.

(21) Appl. No.: 14/535,514

(22) Filed: Nov. 7, 2014

(65) Prior Publication Data

US 2016/0129337 A1 May 12, 2016

(51) Int. Cl.
*A63C 17/26* (2006.01)
*A63C 17/01* (2006.01)

(52) U.S. Cl.
CPC ..... *A63C 17/262* (2013.01); *A63C 17/012* (2013.01); *A63C 17/015* (2013.01)

(58) Field of Classification Search
CPC ..... A63C 17/262; A63C 17/015; A63C 17/0006; A63C 17/01; A63C 17/011; A63C 17/017; A63C 17/012; A63C 17/0093; A63C 2017/0053; A63C 2203/42
USPC ..... 280/87.042
See application file for complete search history.

(56) References Cited

U.S. PATENT DOCUMENTS

| | | | | |
|---|---|---|---|---|
| 5,544,919 | A * | 8/1996 | Tinkler | A63C 17/0006 280/809 |
| 6,178,665 | B1 * | 1/2001 | MacPhail | A43B 5/0443 36/117.1 |
| 6,193,276 | B1 * | 2/2001 | Sottile | A63C 17/01 280/816 |
| 7,628,413 | B2 | 12/2009 | Gallipoli | |
| 2002/0140195 | A1 * | 10/2002 | Lumb | A63C 17/01 280/87.042 |
| 2007/0032149 | A1 * | 2/2007 | Sebba | A63C 10/04 441/74 |
| 2010/0059957 | A1 * | 3/2010 | Haskell | A43B 5/00 280/87.042 |
| 2015/0001817 | A1 * | 1/2015 | Imbrie | A63C 17/015 280/11.27 |
| 2015/0238845 | A1 * | 8/2015 | Clayton | B62K 3/002 280/87.042 |

* cited by examiner

*Primary Examiner* — John Walters
*Assistant Examiner* — Brian Swenson
(74) *Attorney, Agent, or Firm* — Shannon L Warren

(57) ABSTRACT

A foot cover assembly comprising a foot cover and a base plate is disclosed. The foot cover releaseably attaches to the base plate. The base plate releaseably attaches to a board assembly. A portion of the foot cover is arranged over a deck of the board assembly. The foot cover selectively holds a foot of a rider of the board assembly between the foot cover and the deck.

15 Claims, 23 Drawing Sheets

SKATEBOARD TRUCK SYSTEM AND METHOD

CROSS-REFERENCE TO RELATED APPLICATIONS

Not applicable.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to an improved skateboard truck system. In one embodiment, this disclosure relates to said improved skateboard truck system as applied to longboard skateboards; however, this example is purely exemplary and should not be construed as limiting the disclosed system and method to this category of skateboards only, as will be discussed.

Examples of skateboard trucks are presented in U.S. Pat. Nos. 7,070,193 and 4,076,265. None of the above inventions and patents, taken either singularly or in combination, is seen to describe the instant disclosure as claimed. Accordingly, an improved skateboard truck system would be advantageous.

BRIEF SUMMARY OF THE INVENTION

A foot cover assembly and method of use are disclosed.

First, a foot cover assembly is disclosed comprising a foot cover and a base plate. Said foot cover releaseably attaches to said base plate. Said base plate releaseably attaches to a board assembly. A portion of said foot cover is arranged over a deck of said board assembly. Said foot cover selectively holds a foot of a rider of said board assembly between said foot cover and said deck. Said base plate releaseably attaches to said deck. Said board assembly comprises at least a two wheel assemblies comprising a first wheel assembly and a second wheel assembly. At least a one of said two wheel assemblies releaseably attach to a lower portion of said base plate below said deck. Said foot cover releaseably attaches to an upper portion of said base plate above said deck. Said deck comprises at least a first drop-through cutout. Said lower portion of said base plate slides through said first drop-through cutout of said deck and extends below said deck. Said upper portion of said base plate above said deck attaches above said deck and does not pass through said first drop-through cutout.

Next, a foot cover assembly comprising a foot cover and a base plate is disclosed. Said foot cover releaseably attaches to said base plate. Said base plate releaseably attaches to a board assembly. A portion of said foot cover is arranged over a deck of said board assembly. Said foot cover selectively holds a foot of a rider of said board assembly between said foot cover and said deck.

A method of using a foot cover assembly is disclosed. Said method comprising: releaseably attaching a base plate of a foot cover assembly to a foot cover of said foot cover assembly; attaching said foot cover assembly to a deck; attaching a wheel assembly to said base plate; and holding a foot of a rider under said foot cover.

In one embodiment, said one or more sockets in said lower portion can be separated along said lower portion by a spacing.

Figure 7A:
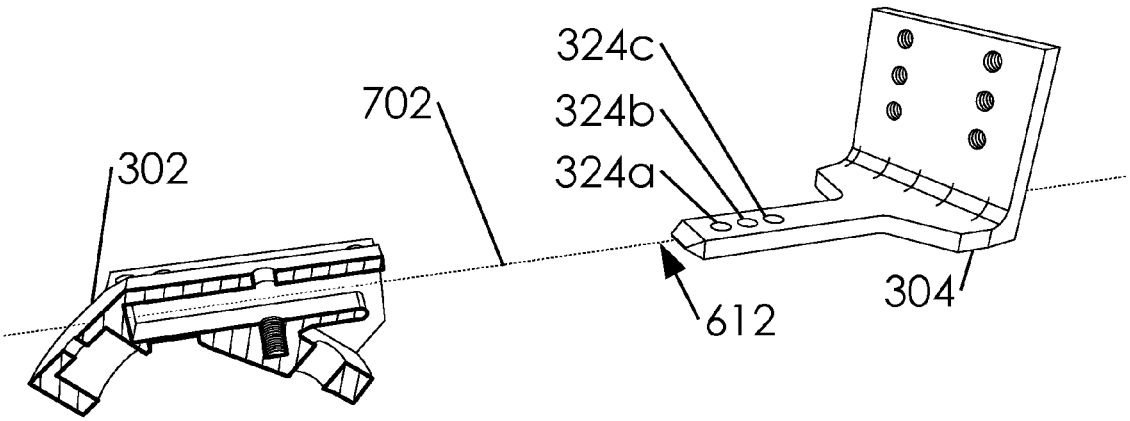

FIG. 7A illustrates a perspective first side overview of L-bracket aligned with a cross-section of base plate.

Figure 7B:
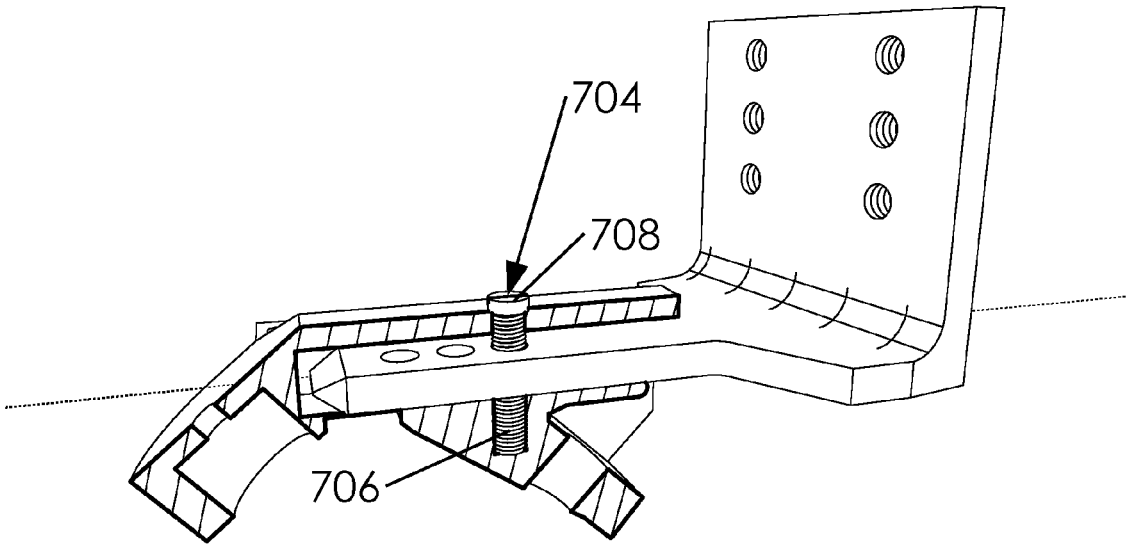
Figure 7C:
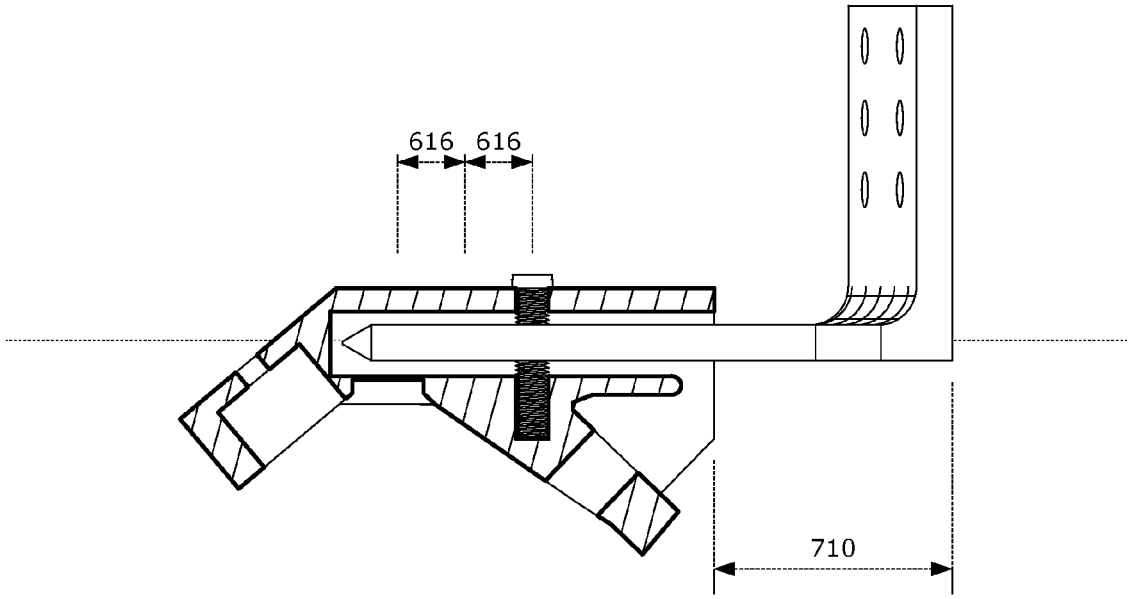

FIGS. 7B and 7C illustrate a perspective front view and an elevated side view of L-bracket 304 attached to a cross-section of base plate.

FIGS. 8A, 8B, 8C, 8D and 8E illustrate an elevated top view, front view, first side view, rear view, and second side view of said foot cover.

Figure 8A:
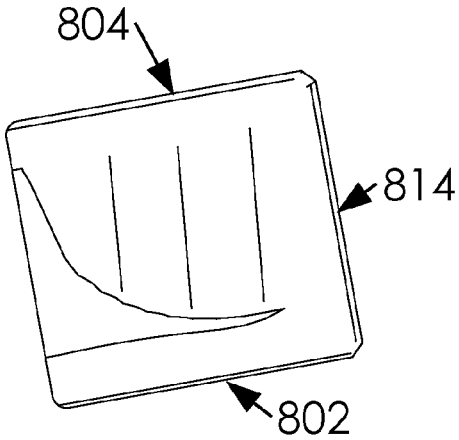
Figure 8B:
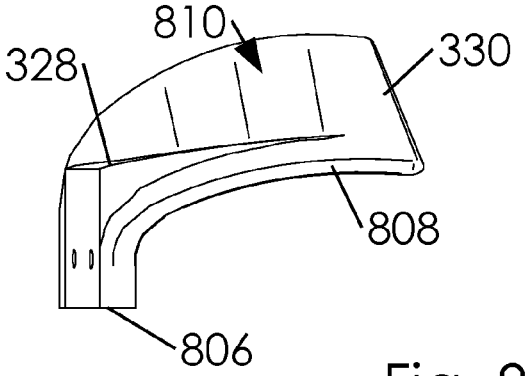
Figure 8C:
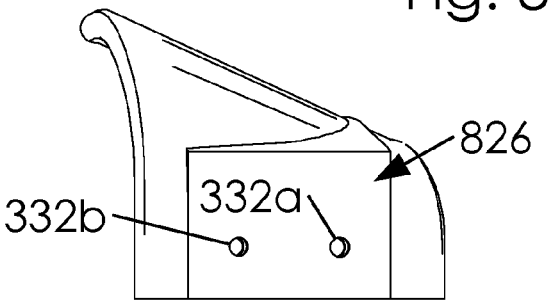
Figure 8D:
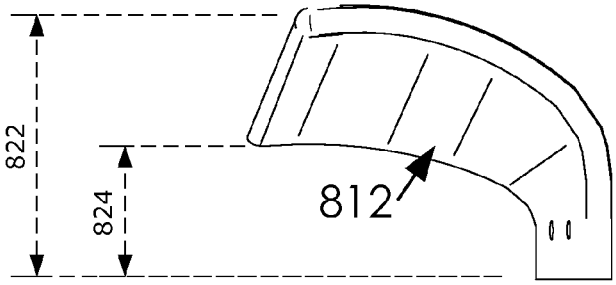
Figure 8E:
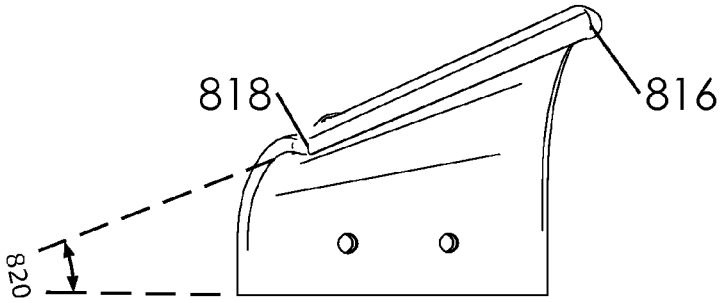
Figure 8F:
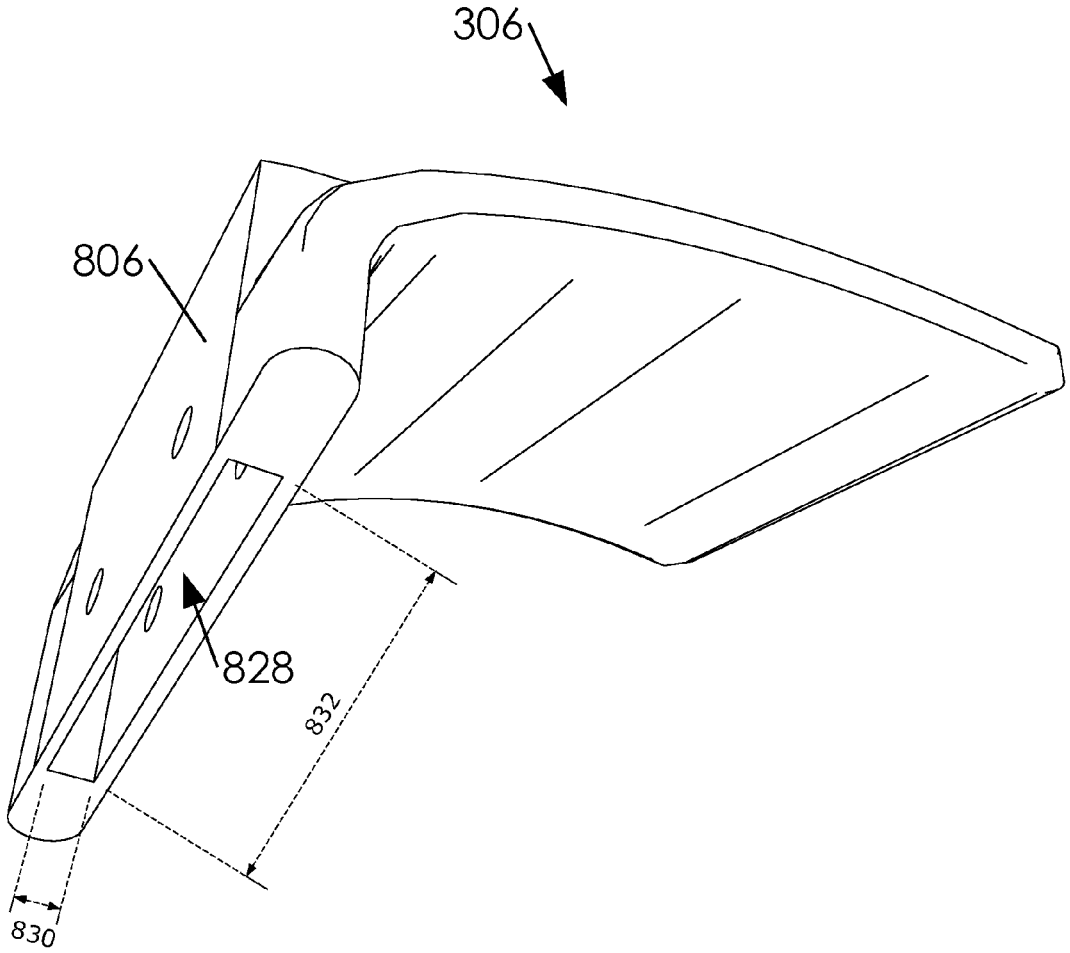

FIG. 8F illustrates a perspective lower first side view of said foot cover.

Figure 9A:
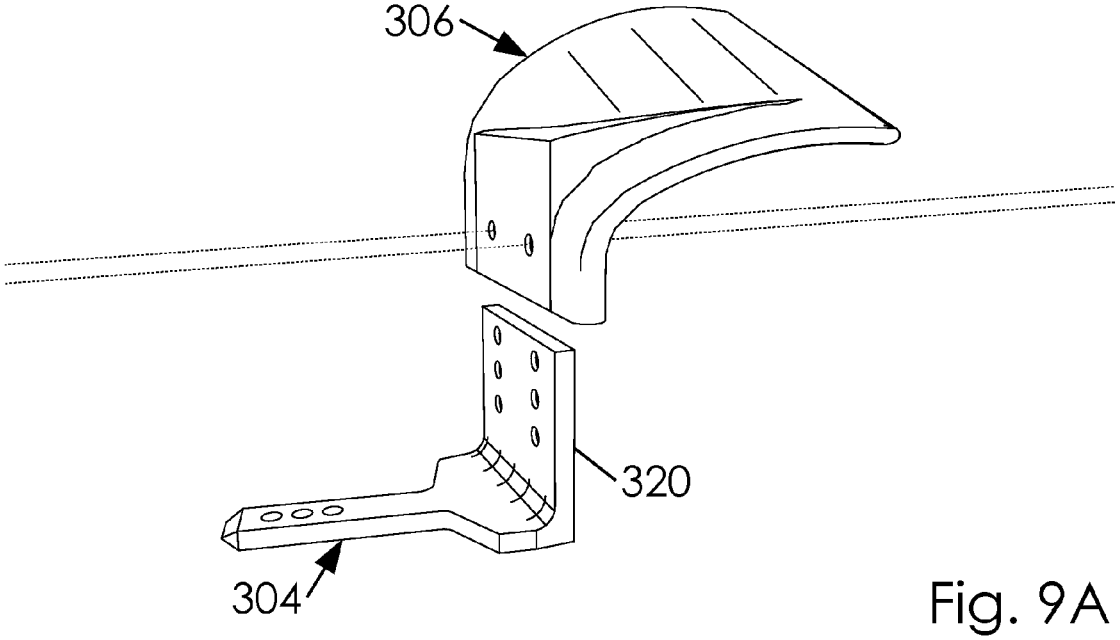
Figure 9B:
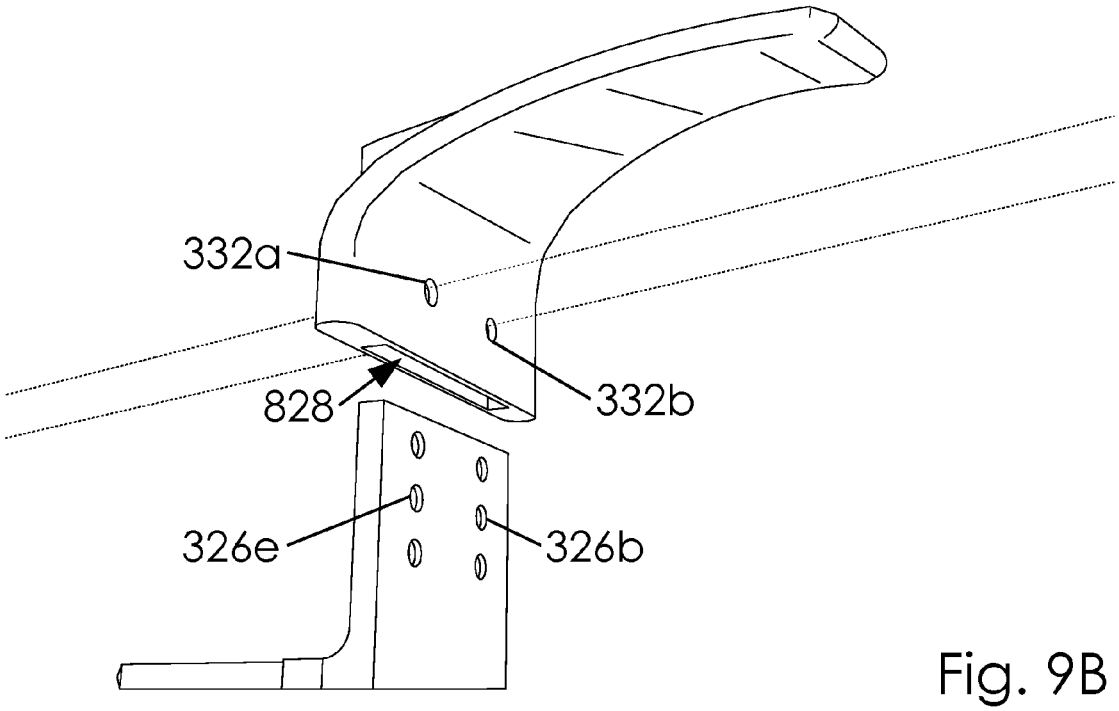

FIGS. 9A and 9B illustrate two perspective overviews of said L-bracket aligned with said foot cover.

Figure 9C:
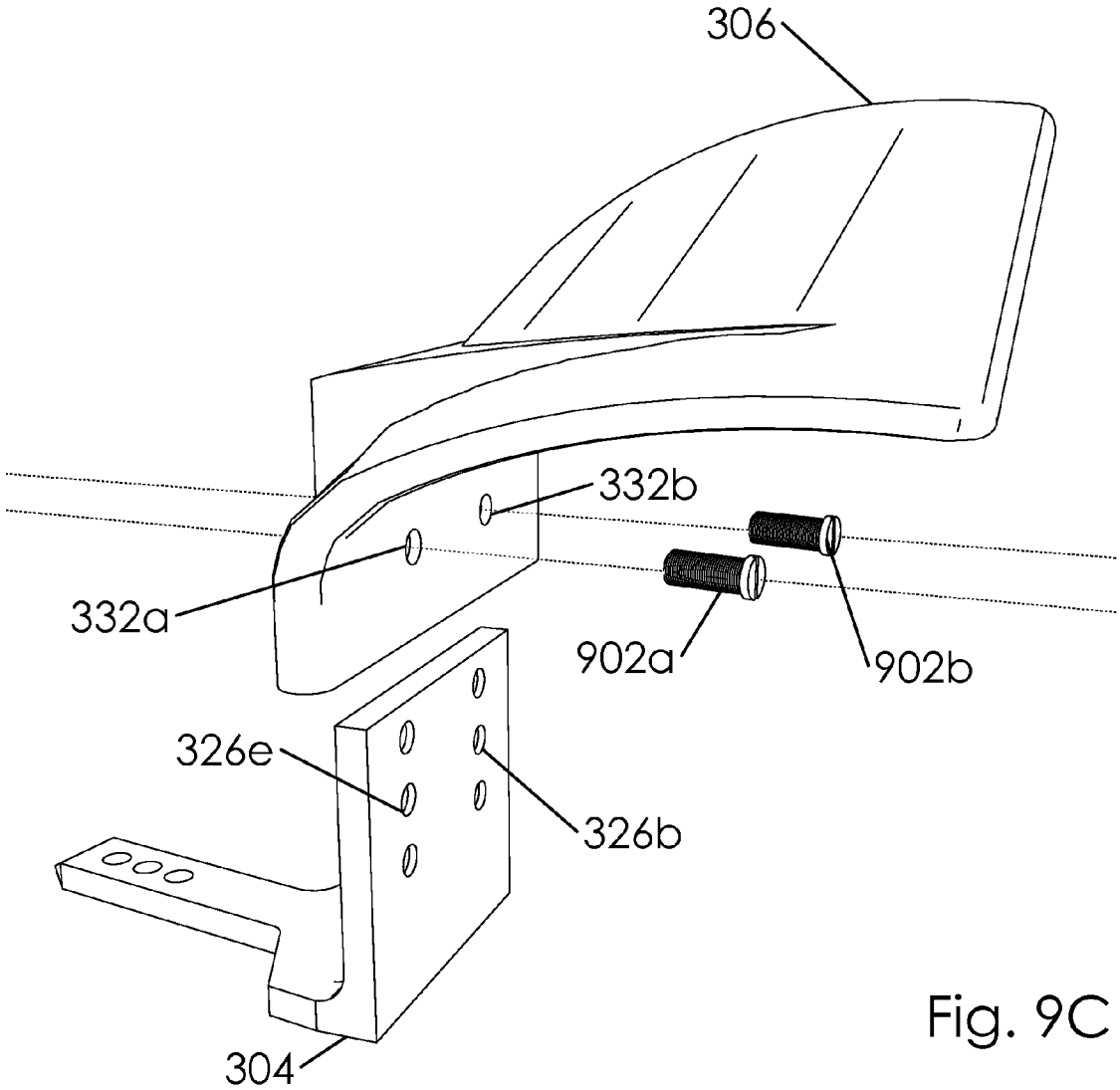

FIG. 9C illustrates a perspective rear view of said L-bracket, said foot cover and one or more fasteners.

Figure 9D:
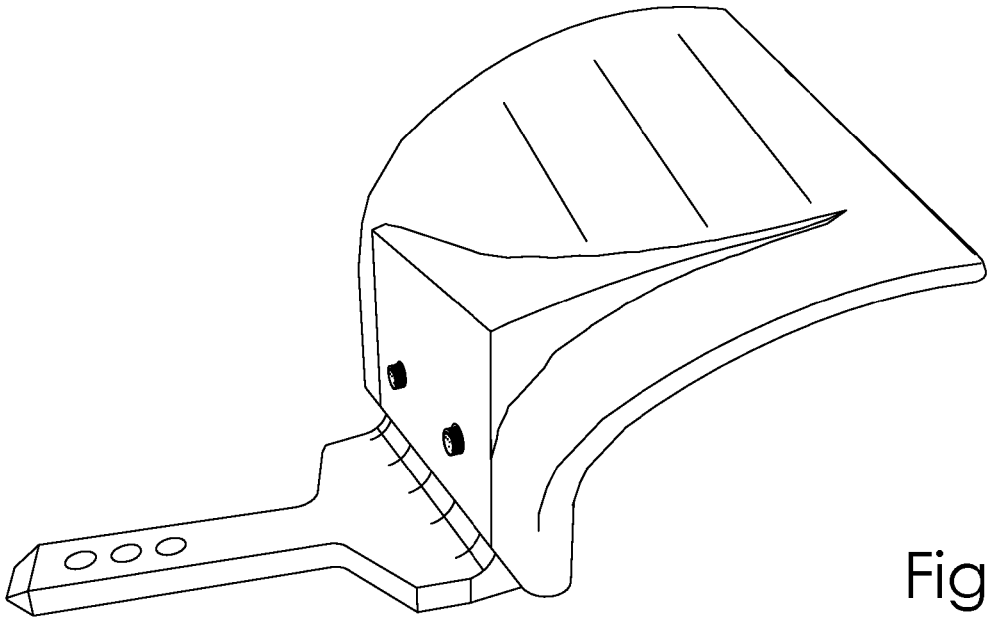
Figure 9E:
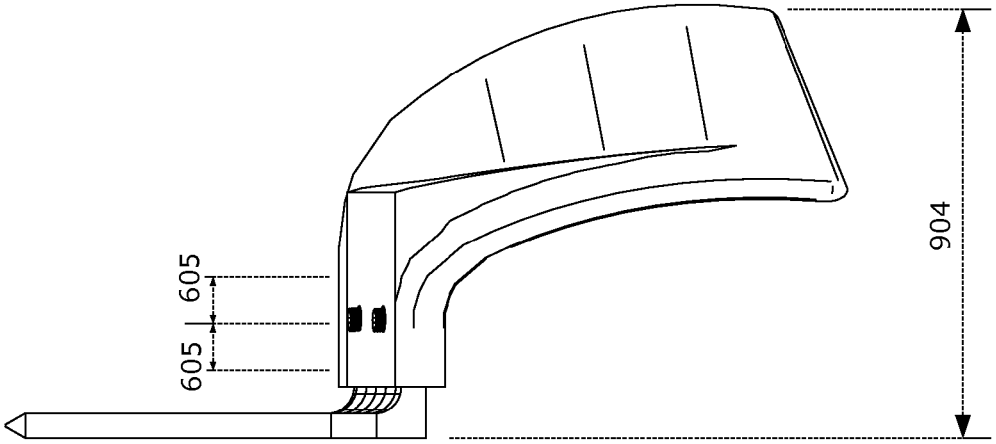

FIGS. 9D and 9E illustrate a perspective overview and an elevated front view of said L-bracket attached to said foot cover.

Figure 10A:
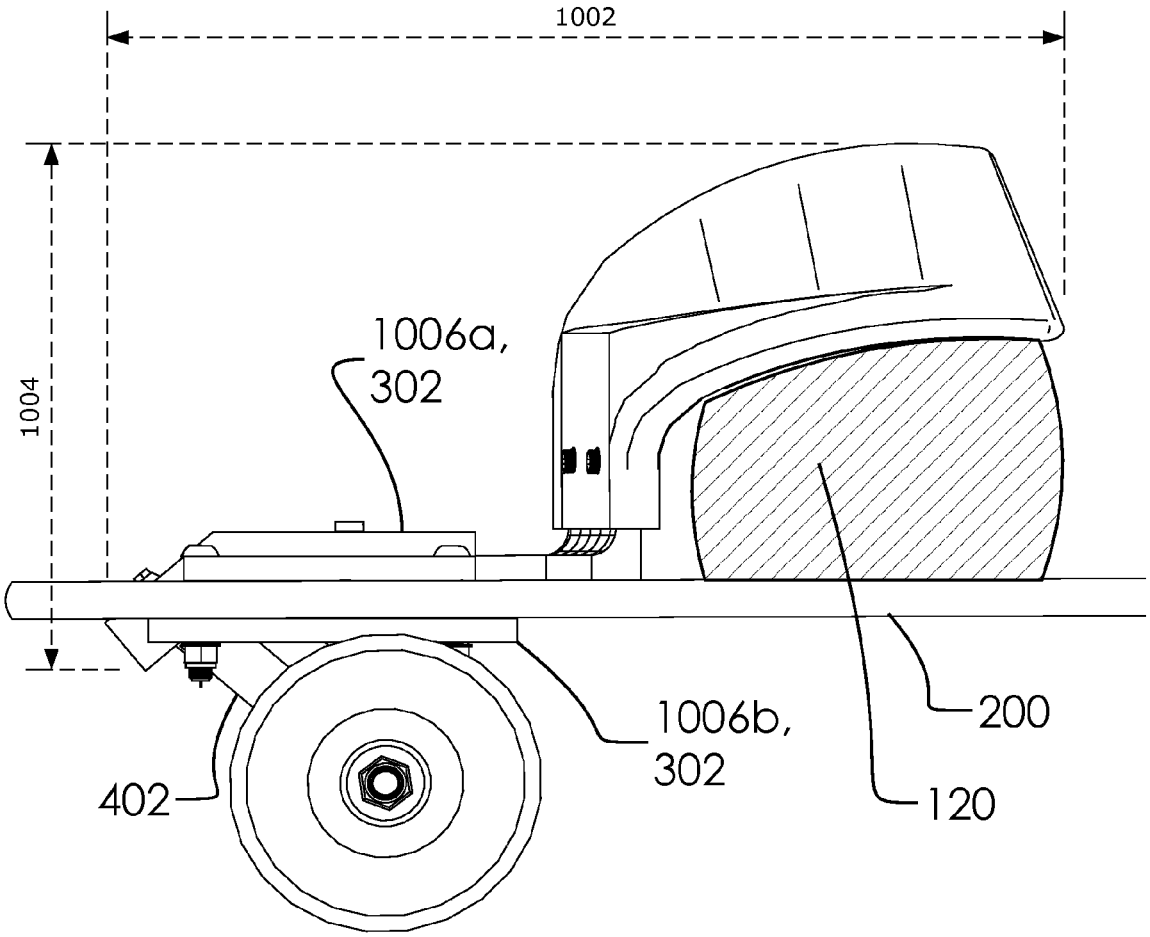
Figure 10B:
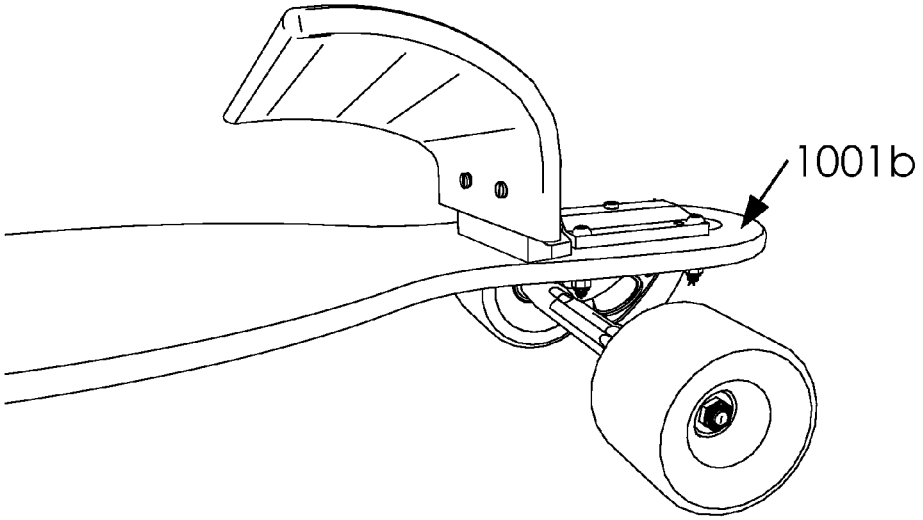
Figure 10C:
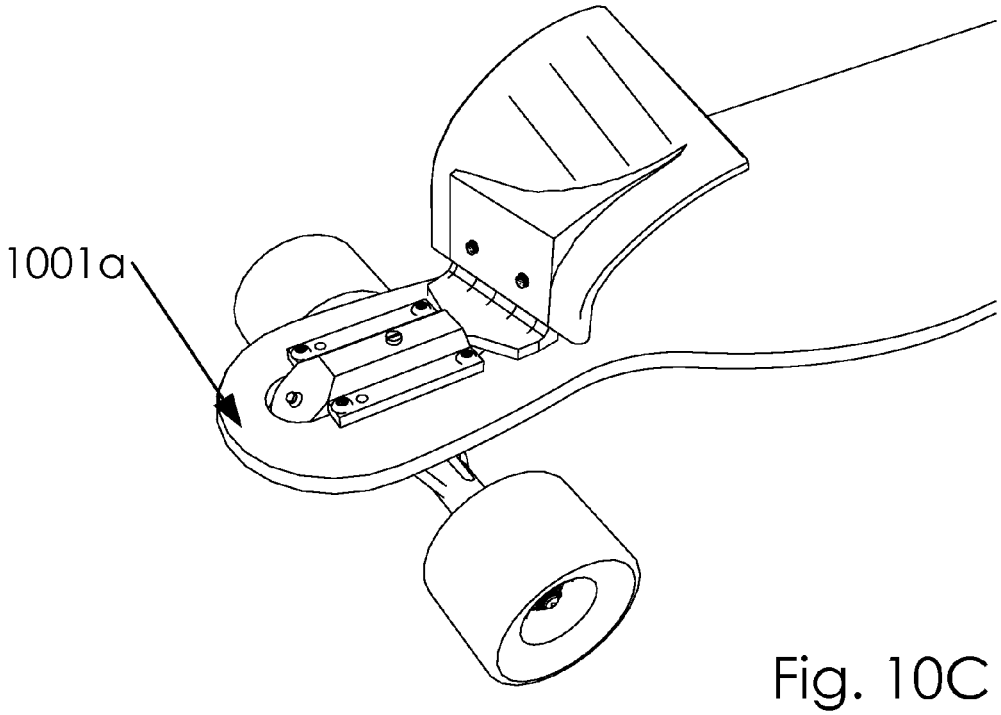

FIGS. 10A, 10B and 10C illustrate an elevated front view, a perspective overview of second end of said board assembly, and a perspective overview of first end of said foot cover assembly attached to said board assembly.

Figure 11:
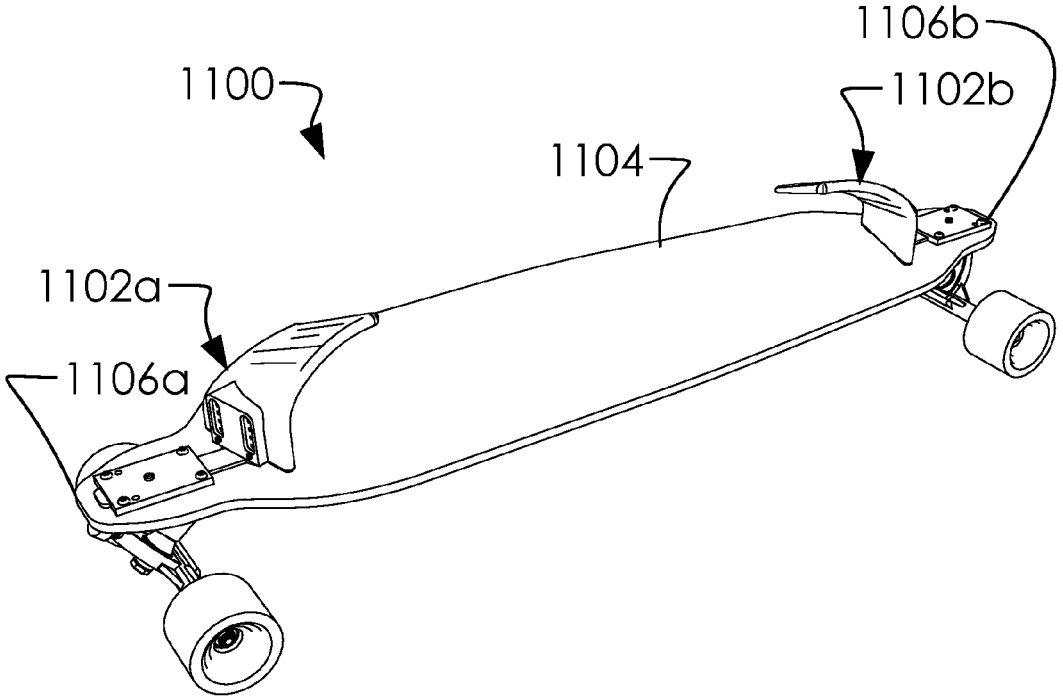

FIG. 11 illustrates a perspective overview of a board assembly.

Figure 12:
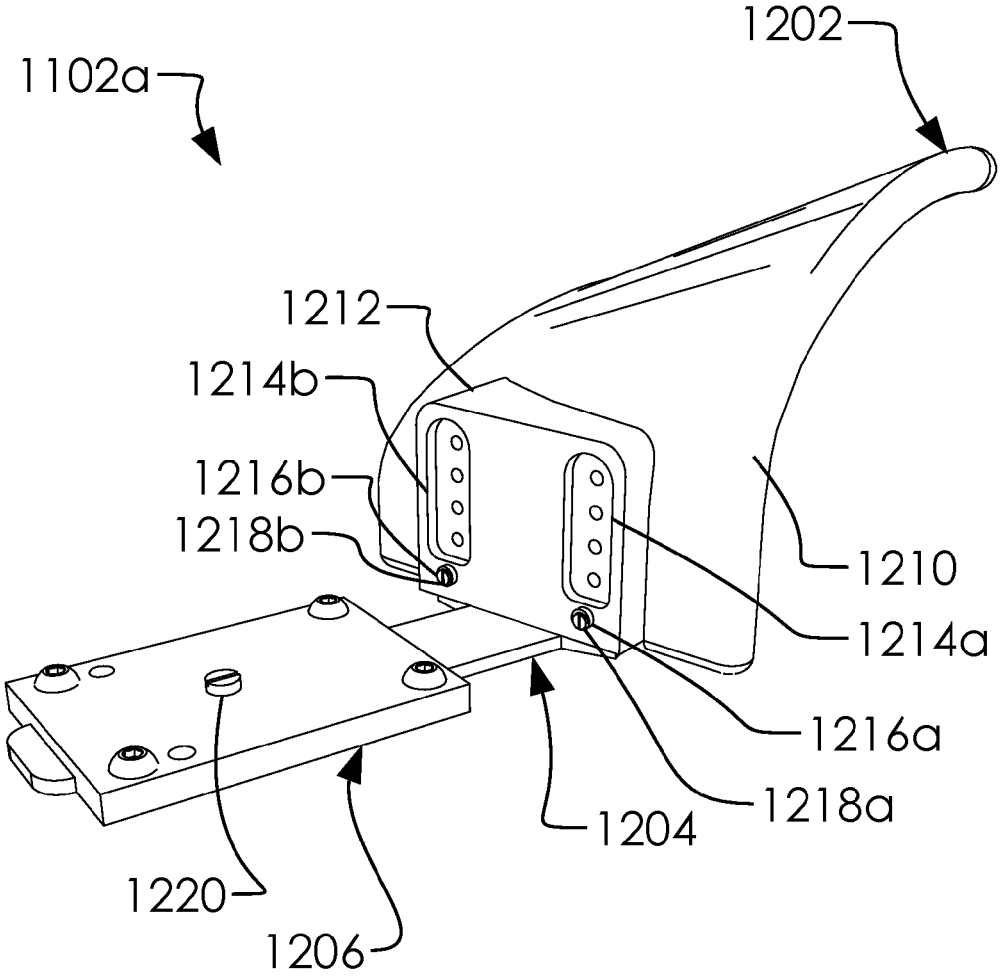

FIG. 12 illustrates a perspective overview of said foot cover assembly.

Figure 13A:
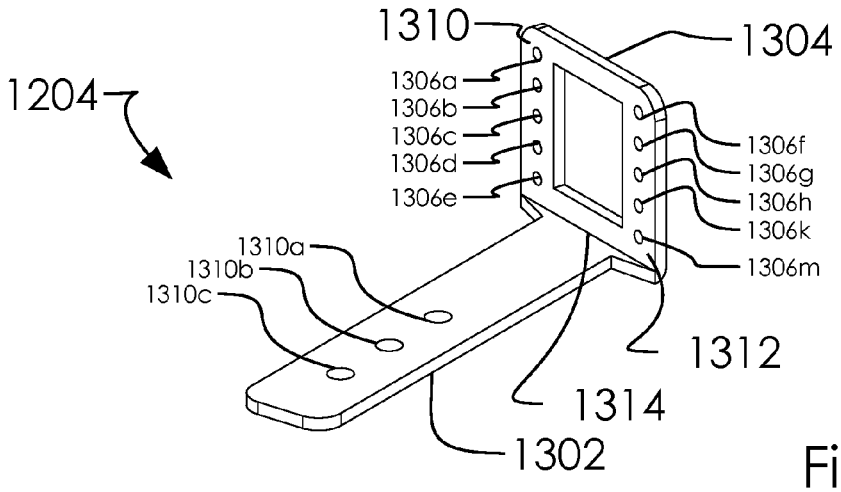
Figure 13B:
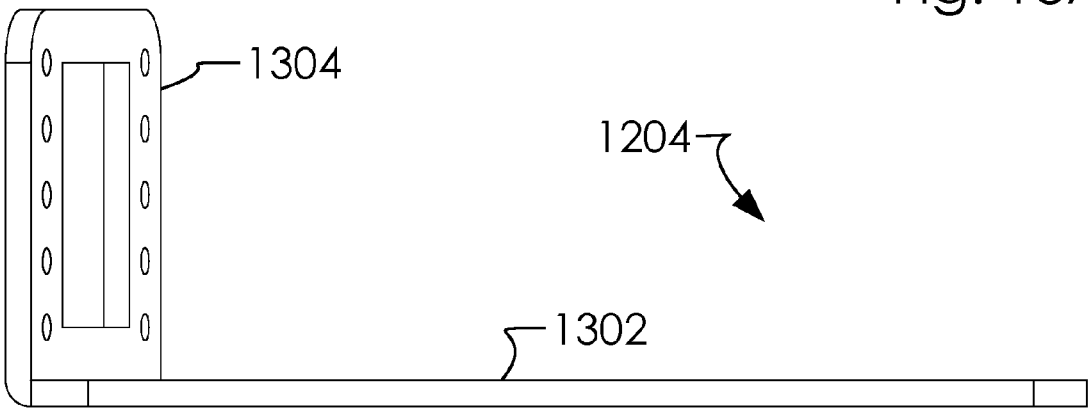
Figure 13C:
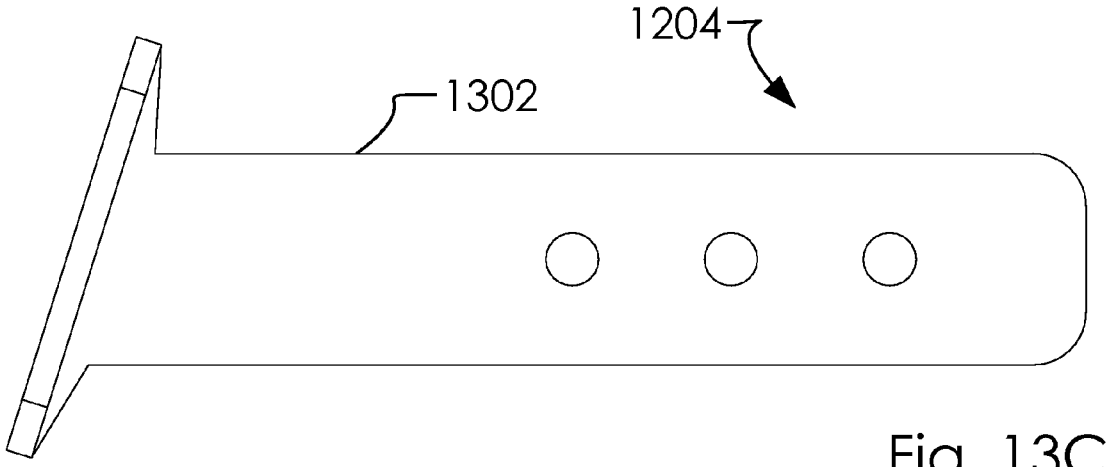

FIGS. 13A, 13B and 13C illustrate an elevated overview, elevated front view and an elevated top view of said L-bracket.

Figure 14A:
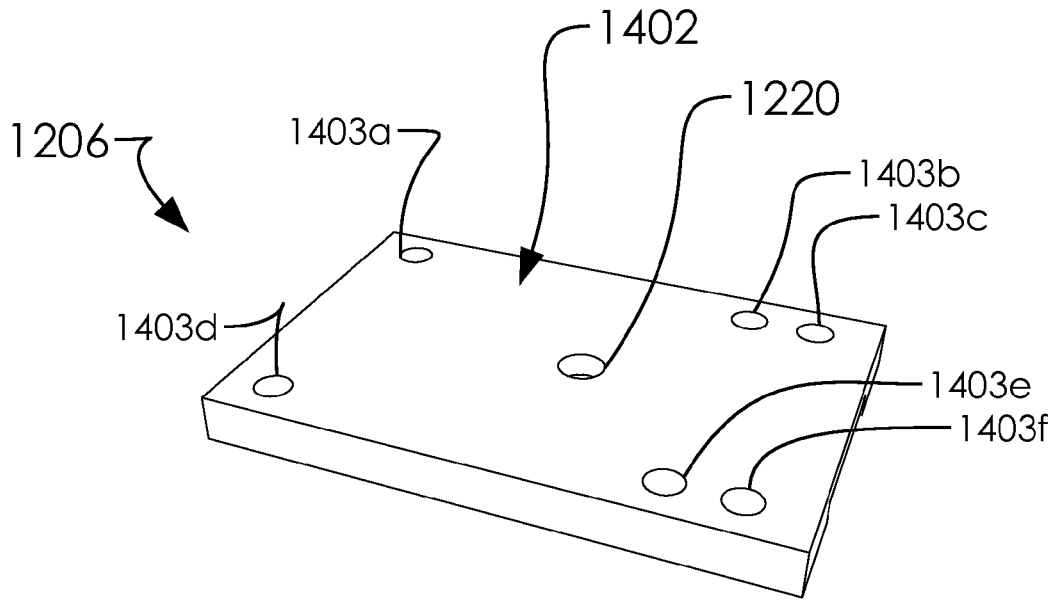
Figure 14B:
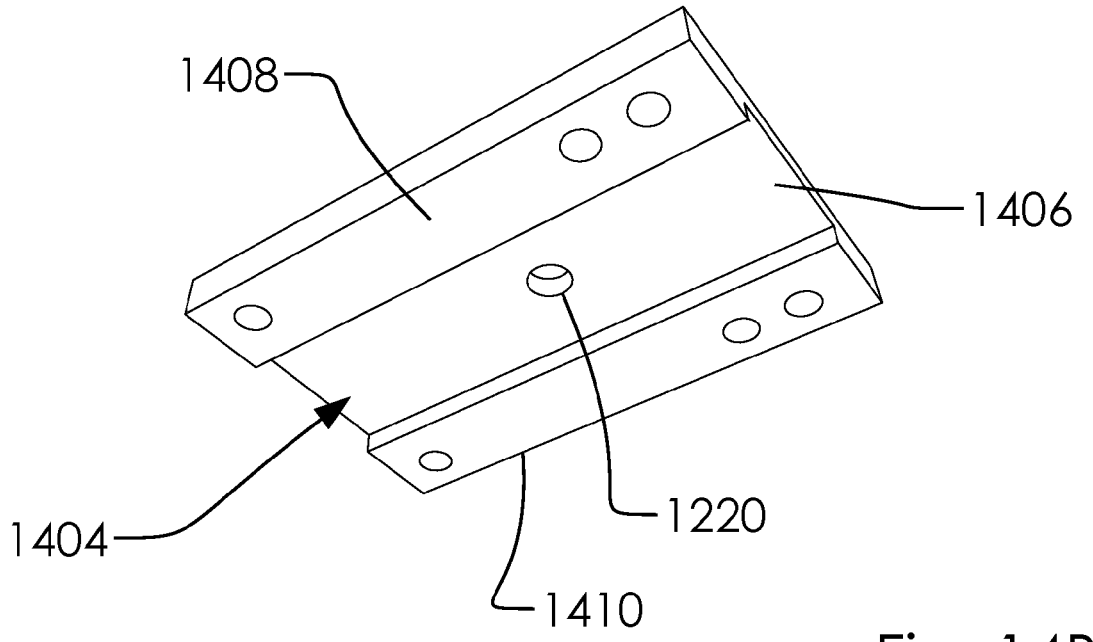

FIGS. 14A and 14B illustrate a perspective overview and lower view of said base plate.

Figure 15A:
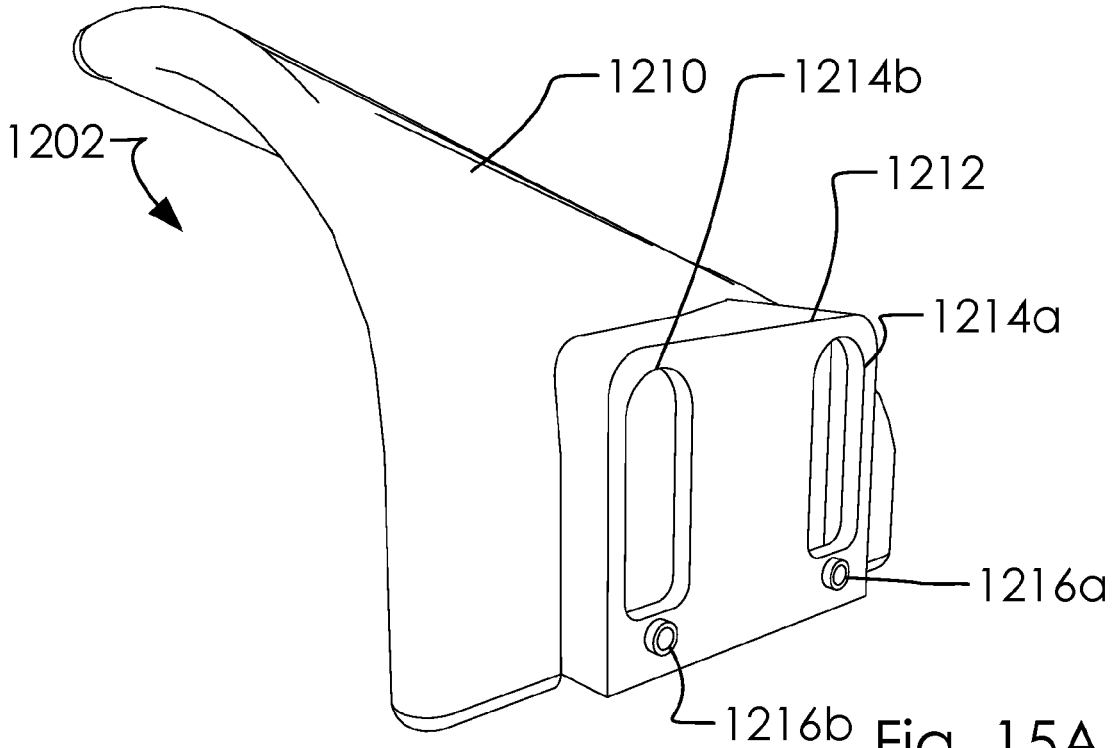
Figure 15B:
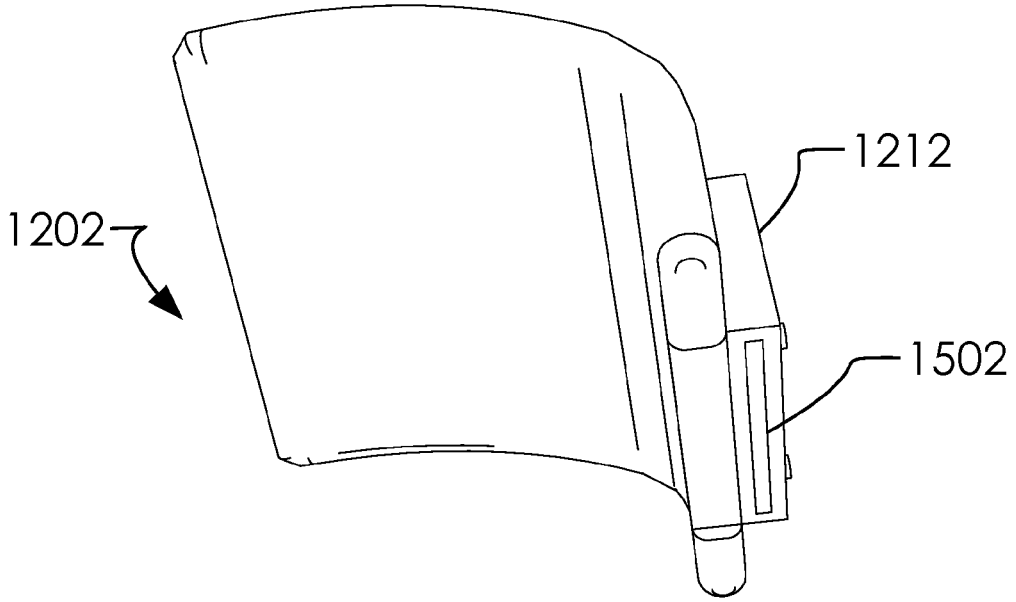

FIGS. 15A and 15B illustrate a perspective overview and a lower view of said foot cover.

Figure 16A:
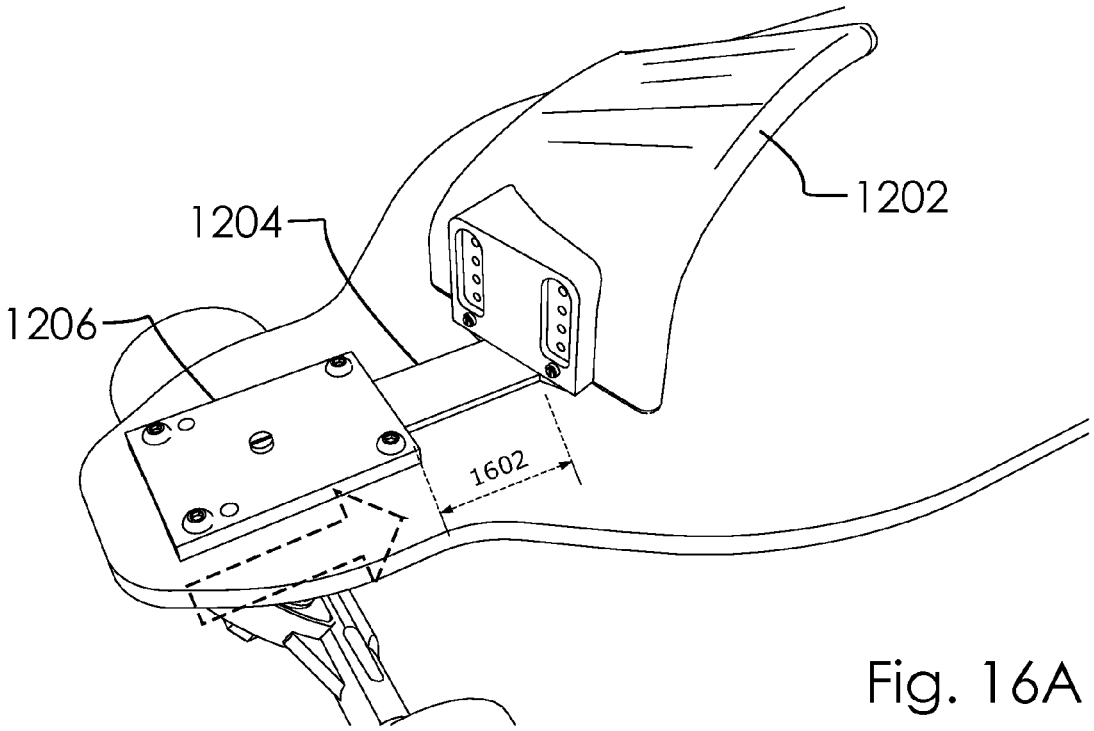
Figure 16B:
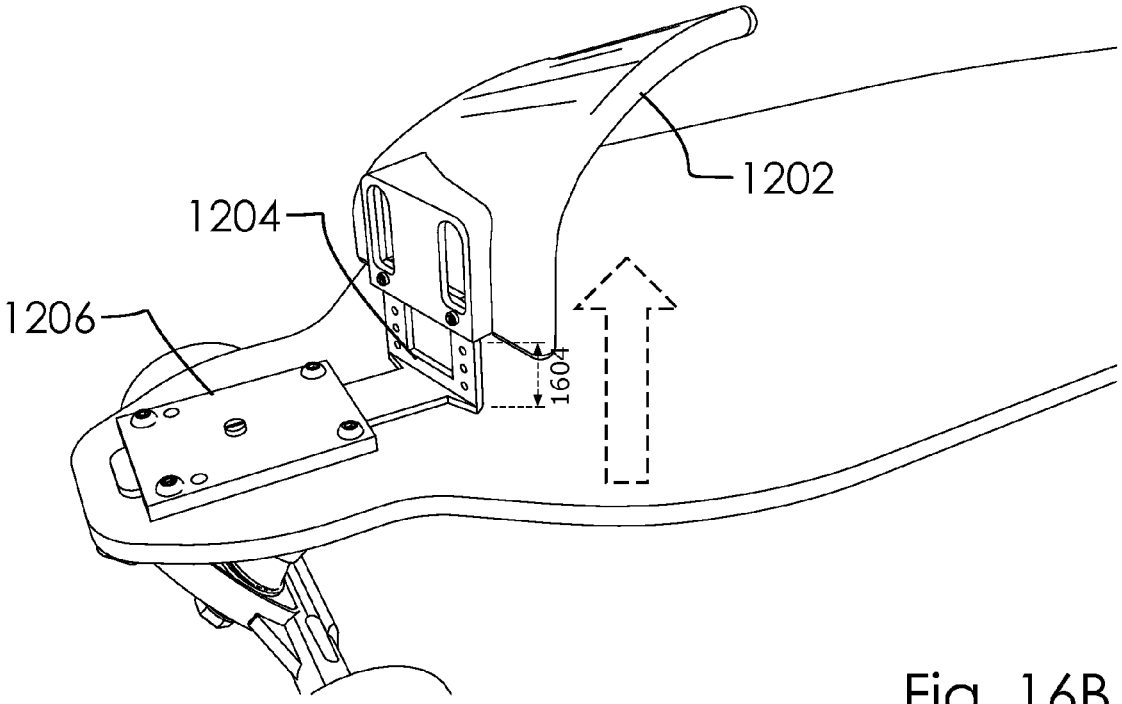

FIGS. 16A and 16B illustrate two perspective overviews of said foot cover assembly attached to said deck.

DETAILED DESCRIPTION OF THE INVENTION

Described herein is an improved skateboard truck system. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
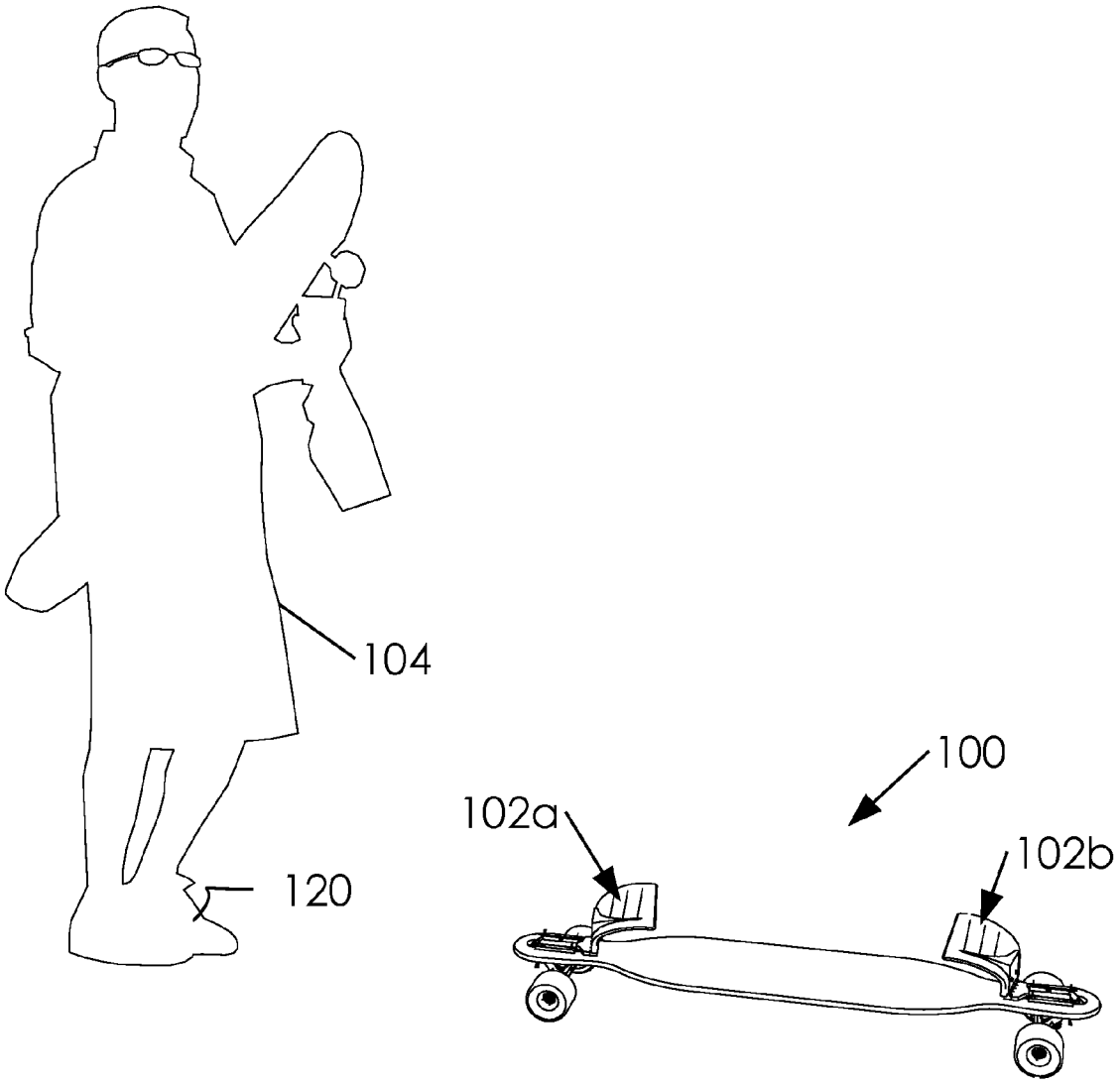
FIG. 1 illustrates a perspective overview of a board assembly with one or more foot cover assemblies.
Figure 2A:
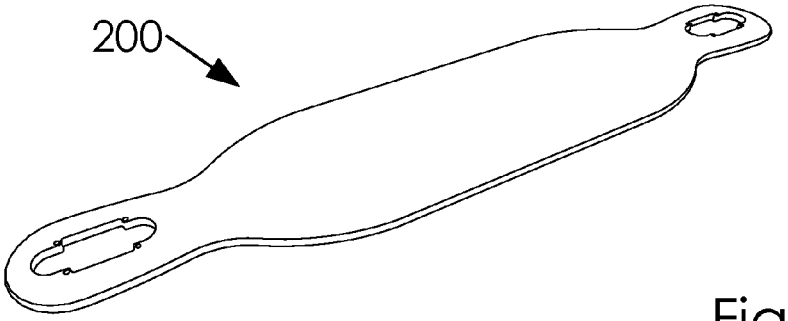
FIGS. 2A, 2B, 2C and 2D illustrate a perspective overview, an elevated top view, an elevated side view and an elevated detailed top view of a deck.
Figure 2B:
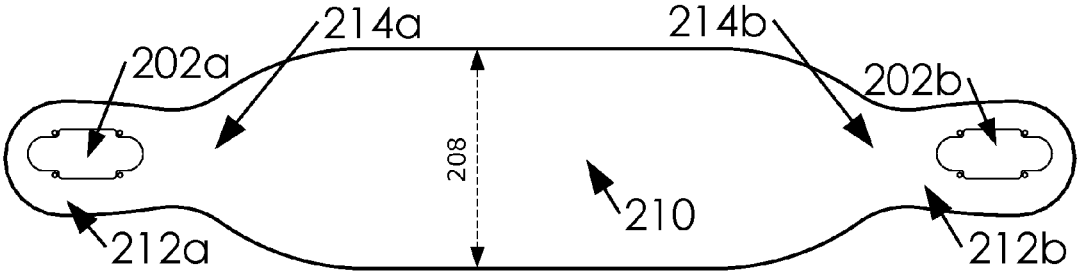
Figure 2C:
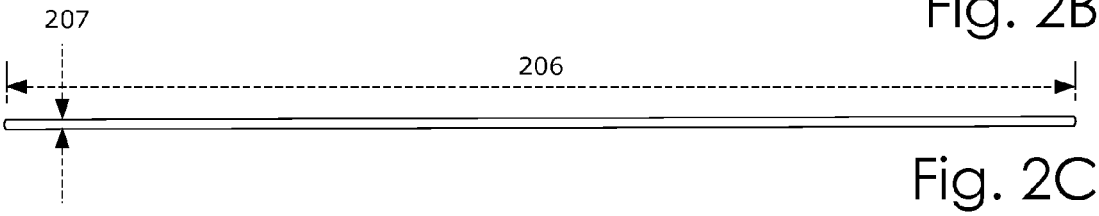
Figure 2D:
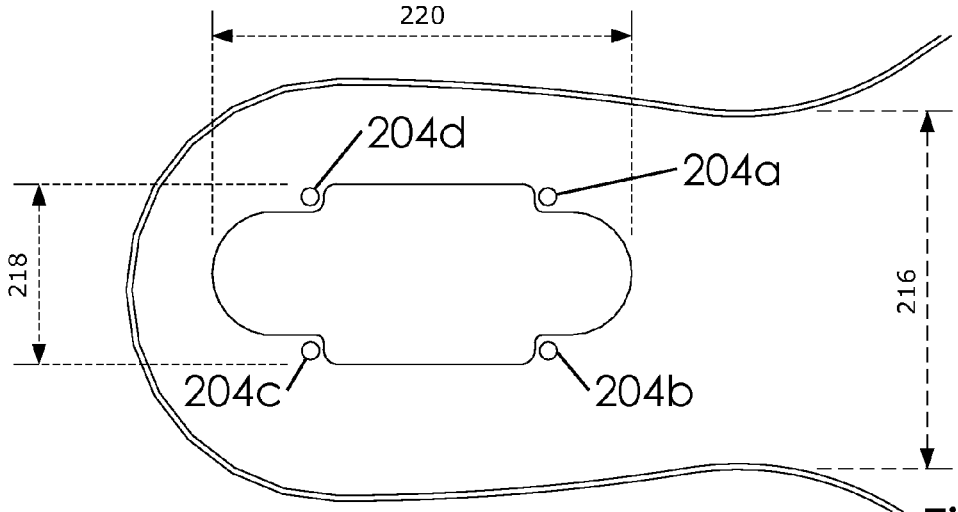

FIG. 1 illustrates a perspective overview of a board assembly 100 with one or more foot cover assemblies. In one embodiment, board assembly 100 can comprise said one or more foot cover assemblies. In one embodiment, said one or more foot cover assemblies can comprise a foot cover assembly 102*a* and a foot cover assembly 102*b*. In one embodiment, board assembly 100 can be used by a rider 104. In one embodiment, board assembly 100 can comprise a longboard, a skateboard, a mountain board, or similar recreational board with wheels. In one embodiment, said rider 104 can comprise a foot 120

FIGS. 2A, 2B, 2C and 2D illustrate a perspective overview, an elevated top view, an elevated side view and an elevated detailed top view of a deck 200. Board assembly 100 can comprise deck 200. In one embodiment, deck 200 can support said rider 104. In one embodiment, said one or more foot cover assemblies can attach to deck 200. In one embodiment, deck 200 can comprise two drop-through cutouts. Said two drop-through cutouts can comprise a first drop-through cutout 202*a* and a second drop-through cutout 202*b*.

In one embodiment, each of said one or more foot cover assemblies can attach one of said two drop-through cutouts. In one embodiment, each of said two drop-through cutouts can comprise a plurality of sockets; wherein, each of said plurality of sockets can be capable of receiving a portion of a screw assembly. Said plurality of sockets can comprise a first socket 204*a*, a second socket 204*b*, a third socket 204*c* and a fourth socket 204*d*. Deck 200 can comprise a length 206, a height 207 and a width 208. Deck 200 can comprise a center portion 210, a first end 212*a*, a second end 212*b*, a first neck 214*a* and a second neck 214*b*. In one embodiment, said width 208 of center portion 210 can taper at said first neck 214*a* and second neck 214*b*. In one embodiment, said first end 212*a* and second end 212*b* can comprise a width 216.

Deck 200 can comprise a pintail deck, a drop-through deck (as illustrated in FIGS. 2A-2D), a hybrid, a cruiser, and/or similar. Drop-Through boards can comprise a shape (as viewed from an elevated side view) wherein said center portion 210 is lower than first end 212*a* and/or second end 212*b*. This can be achieved by either of said two drop-through cutouts, where trucks are mounted through said deck 200, or a "dropped" deck where said deck 200 is pressed in such a way that the truck mounts are placed higher than the standing platform.

In one embodiment, said two drop-through cutouts can comprise a width 218 and length 220. In one embodiment, said two drop-through cutouts can comprise a said plurality of sockets surrounding an edge portion of said two drop-through cutouts. In one embodiment, said two drop-through cutouts can each receive one of said one or more foot cover assemblies.

Figure 3A:
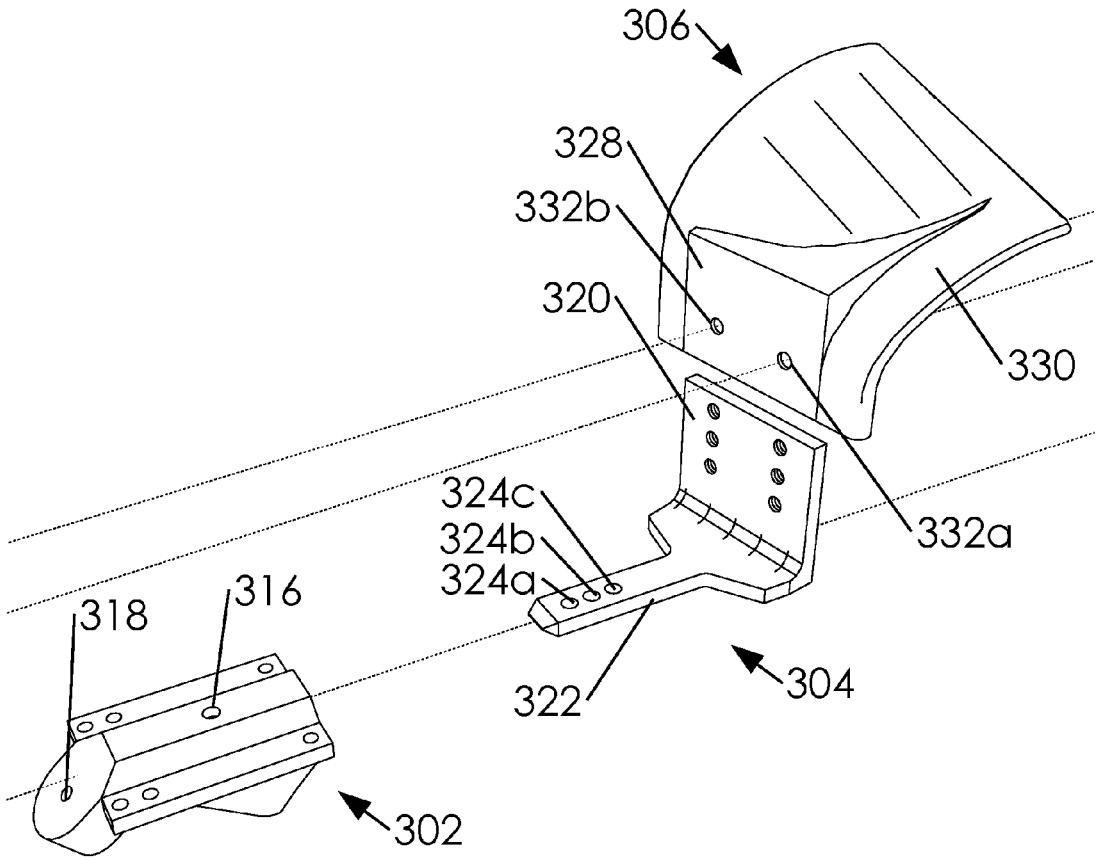
FIGS. 3A, 3B and 3C illustrate a perspective overview, an elevated side view, and an elevated top view of a base plate, an L-bracket and a foot cover.
Figure 3B:
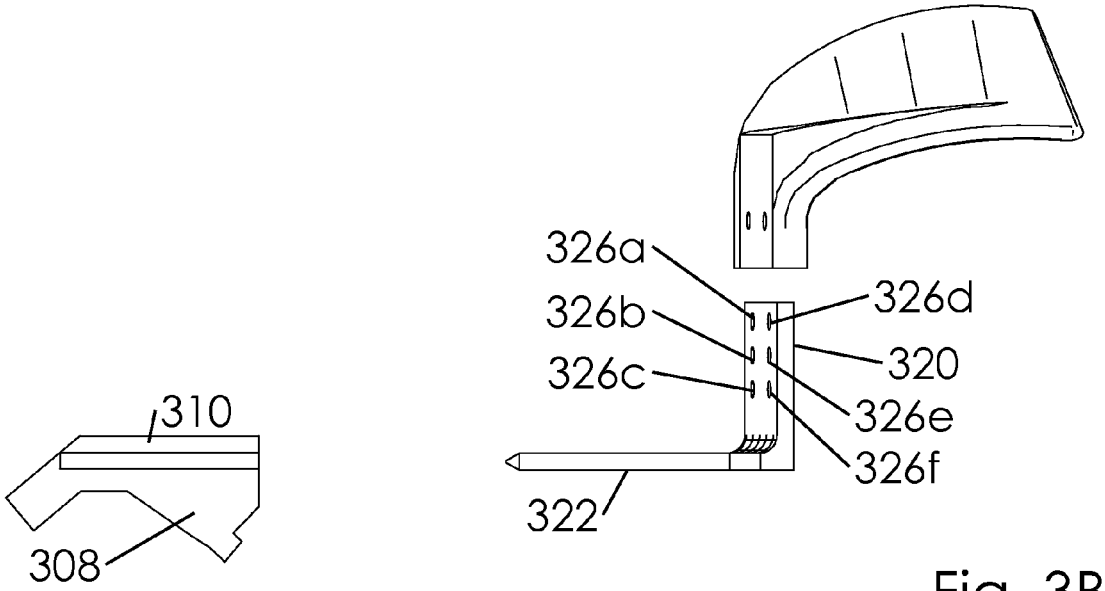
Figure 3C:
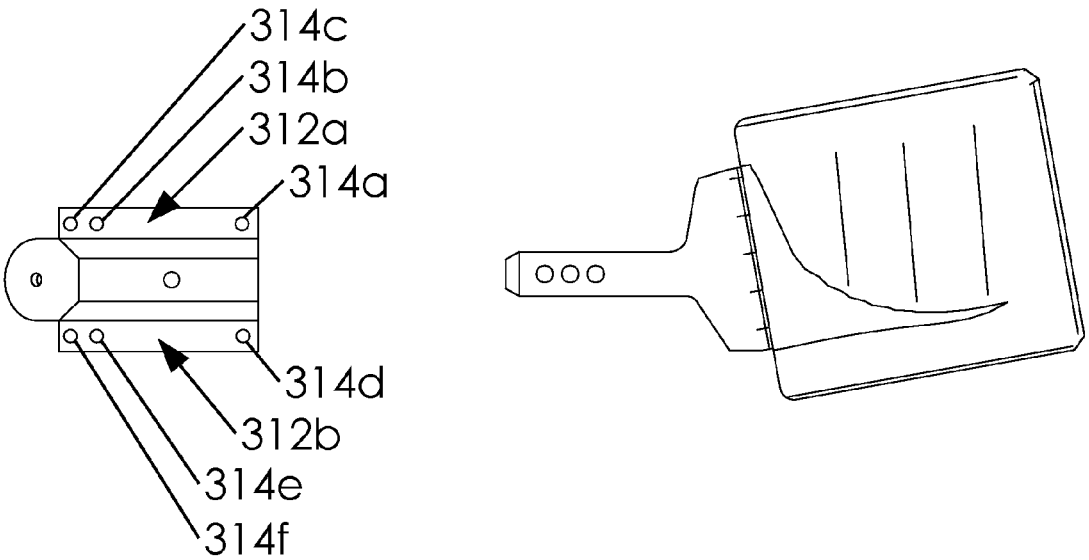

FIGS. 3A, 3B and 3C illustrate a perspective overview, an elevated side view, and an elevated top view of a base plate 302, an L-bracket 304 and a foot cover 306. In one embodiment, said one or more foot cover assemblies can each comprise said base plate 302, said L-bracket 304 and said foot cover 306. In one embodiment, said base plate 302 can attach to L-bracket 304. In one embodiment, foot cover 306 can attach to L-bracket 304. Base plate 302 can comprise a lower portion 308, an upper portion 310, and a plurality of side portions. Said plurality of side portions in said base plate 302 can comprise a first side portion 312*a* and a second side portion 312*b*. In one embodiment, lower portion 308 can comprise a portion of base plate 302 below said plurality of side portions in said base plate 302. In one embodiment, upper portion 310 can comprise a portion of base plate 302 above said plurality of side portions in said base plate 302. Base plate 302 can comprise a plurality of side apertures in said base plate 302. In one embodiment, said plurality of side apertures in said base plate 302 can comprise a first socket 314*a*, a second socket 314*b*, a third socket 314*c* a fourth socket 314*d*, a fifth socket 314*e* and a sixth socket 314*f*. In one embodiment, first side portion 312*a* can comprise first socket 314*a*, second socket 314*b* and third socket 314*c*. In one embodiment, second side portion 312*b* can comprise fourth socket 314*d*, fifth socket 314*e* and sixth socket 314*f*. Thus, in one embodiment, base plate 302 can comprise said plurality of side apertures in said plurality of side portions. Base plate 302 can comprise a center aperture 316 and a front aperture 318.

L-bracket 304 can comprise an upper portion 320 and a lower portion 322 and a support brace 334. In one embodiment, said support brace 334 attaches to said upper portion 320 and said lower portion 322 at a diagonal angle. In one embodiment, said support brace 334 adds additional strength to the connection between said upper portion 320 and said lower portion 322. In one embodiment, lower portion 322 can comprise a plurality of sockets. In one embodiment, said one or more sockets in said lower portion 322 can comprise a first socket 324*a*, a second socket 324*b* and a third socket 324*c*. In one embodiment, upper portion 320 can comprise a plurality of sockets. In one embodiment, said one or more sockets in said upper portion 320 can comprise a first socket 326*a*, a second socket 326*b*, a third socket 326*c*, a fourth socket 326*d*, a fifth socket 326*e*, and a sixth socket 326*f*. In one embodiment, said one or more sockets in said upper portion 320 can be arranged in pairs of sockets. For example, in one embodiment, said one or more sockets in said upper portion 320 can comprise three of said pairs of sockets; viz., first socket 326*a* with fourth socket 326*d*, second socket 326*b* with fifth socket 326*e*, and third socket 326*c* with said sixth socket 326*f*.

Foot cover 306 can comprise a first portion 328 and a second portion 330. In one embodiment, foot cover 306 can comprise one or more sockets. In one embodiment, said one or more sockets in said foot cover 306 can comprise a first socket 332*a* and a second socket 332*b*.

In one embodiment, said one or more sockets in said upper portion 320 and/or said one or more sockets in said foot cover 306 can comprise a female threading capable of receiving a screw.

Figure 4:
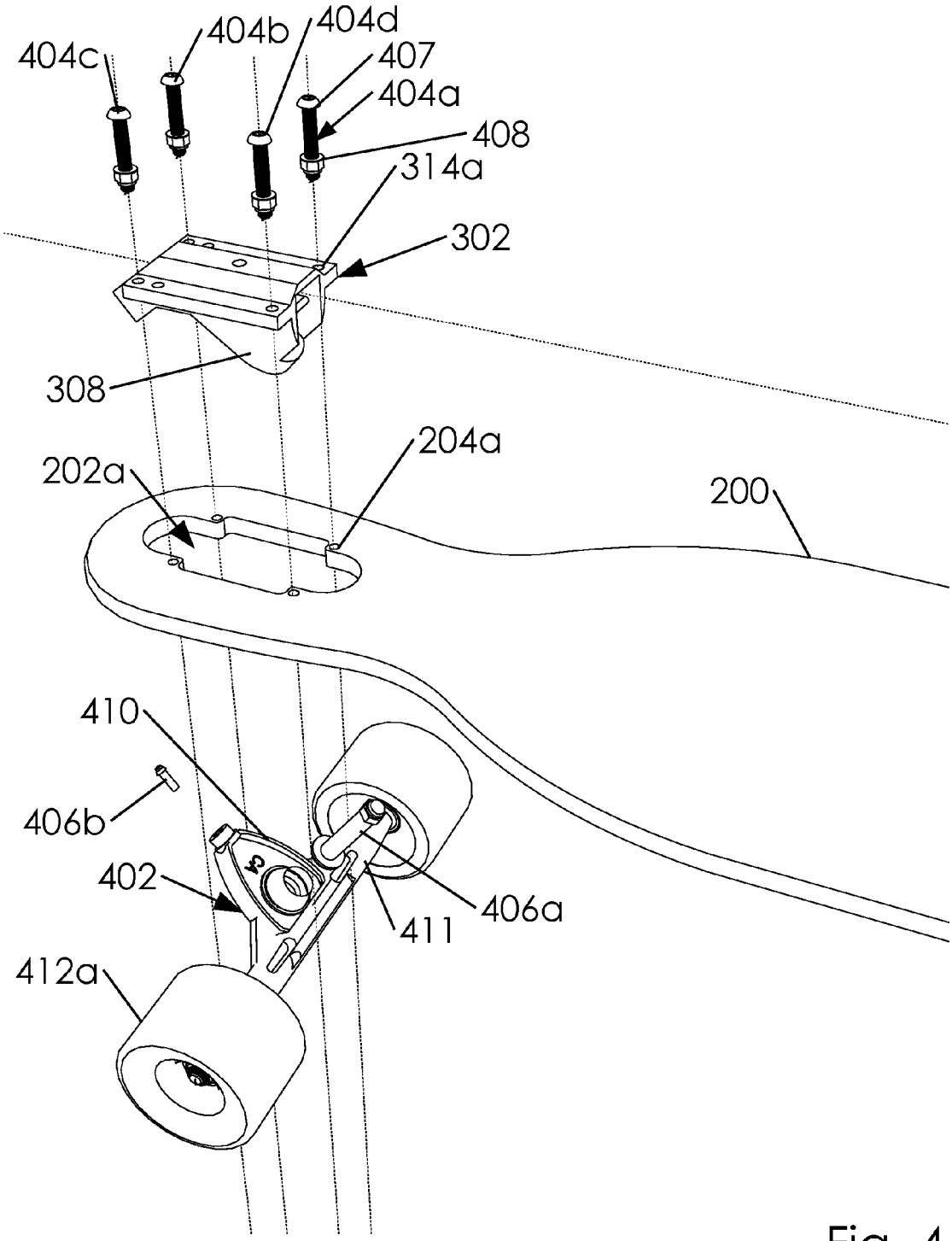
FIG. 4 illustrates an exploded perspective overview of a truck assembly and said deck.

FIG. 4 illustrates an exploded perspective overview of a truck assembly and said deck 200. In one embodiment, truck assembly can comprise said base plate 302, a wheel assembly 402, and one or more screw assemblies. As discussed supra, board assembly 100 can comprise said one or more foot cover assemblies; accordingly, the following discussion of attaching said foot cover assembly 102*a* to said first drop-through cutout 202*a* can be used to attach said foot cover assembly 102*b* to said second drop-through cutout 202*b*.

In one embodiment, attaching said base plate 302 to said deck 200 by: aligning said base plate 302 with one of said two drop-through cutouts, sliding said lower portion 308 through said one of said two drop-through cutouts, and securing said base plate 302 to said deck 200 with a plurality of said one or more screw assemblies. In one embodiment, said plurality of said one or more screw assemblies can comprise a first screw assembly 404*a*, a second screw assembly 404*b*, a third screw assembly 404*c* and a fourth screw assembly 404*d*. In one embodiment, aligning said base plate 302 with said one of said two drop-through cutouts can further comprise: aligning said plurality of side apertures in said base plate 302 with one or more of said plurality of sockets of said deck 200. Each of said one or more screw assemblies can comprise a screw 407 and a nut 408. In one embodiment, securing said base plate 302 to said deck 200 with said one or more screw assemblies can comprise: aligning each of said screws 407 with one of said plurality of side apertures in said base plate 302 and said plurality of sockets of said deck 200; sliding said screws 407 through said plurality of side apertures in said base plate 302 and through said plurality of sockets of said deck 200; and attaching said nuts 408 to each of said screws 407.

In one embodiment, wheel assembly 402 can attach to base plate 302. Wheel assembly 402 can comprise a central portion 410, an axel 411 and two wheels. In one embodiment, wheel assembly 402 attaches to base plate 302 with one or more of said one or more screw assemblies (such as a king pin bolt 406*a* and a screw assembly 406*b*), as is well-known in the art. Said two wheels can comprise a first wheel 412*a* and a second wheel 412*b*. In one embodiment, said two wheels can attach at opposing ends of axel 411. In one embodiment, axel 411 attaches to said central portion 410. In one embodiment, one or more bushings can attach on both sides of said wheel assembly 402.

In one embodiment, truck assembly can comprise a metal turning mechanism capable of attaching deck 200 to wheel assembly 402. Truck assembly can comprise a wide range of styles, with wider embodiments of truck assembly providing a wider turning radius of board assembly 100. In one embodiment, truck assembly can use the motion of a feet and body of said rider 104 to turn said board assembly 100 by pivoting a joint in the middle of the truck. There can comprise two types of trucks used on longboards: reverse kingpin trucks and conventional skateboard trucks (vertical kingpin). Conventional skateboard trucks have the axle on the outside side (towards the nose and tail) of the kingpin, whereas reverse kingpin trucks have the axle on the inside side (towards the center of the board) of the kingpin.

In one embodiment, said board assembly 100 can comprise at least a two wheel assemblies comprising of a first wheel assembly (which can comprise said wheel assembly 402) and a second wheel assembly (not illustrated here). In one embodiment, at least one of said two wheel assemblies can releaseably attach to said deck 200, as illustrated.

FIGS. 5A, 5B, 5C, 5D, 5E and 5F illustrate a perspective rear overview, an elevated top view, an elevated first side view, an elevated second side view, an elevated front view, and an elevated bottom view of base plate 302. In one embodiment, base plate 302 can comprise a key socket 502 capable of receiving said lower portion 322 of said L-bracket 304 and a cutout 510. In one embodiment, key socket 502 can comprise a width 503 and a height 504. In one embodiment, cutout 510 can comprise a width 512, a height 516, and a length 514. In one embodiment, said cutout 510 allows for said support brace 334, attached lower portion 322, to fit within key socket 502.

Figure 5A:
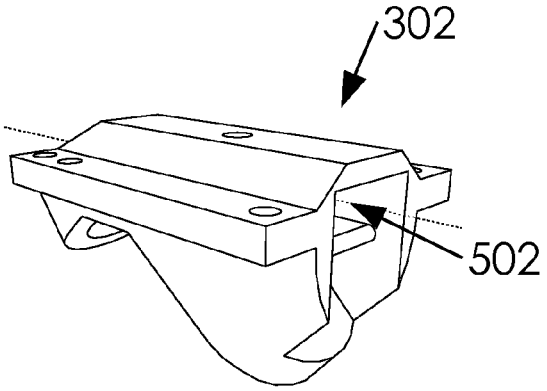
FIGS. 5A, 5B, 5C, 5D, 5E and 5F illustrate a perspective rear overview, an elevated top view, an elevated first side view, an elevated second side view, an elevated front view, and an elevated bottom view of base plate.
Figure 5B:
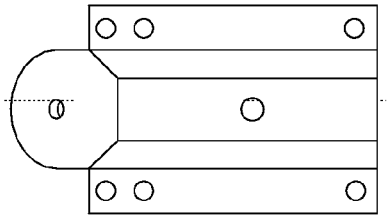
Figure 5C:
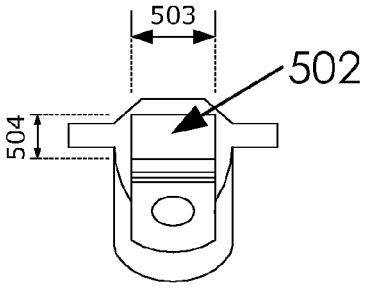
Figure 5D:
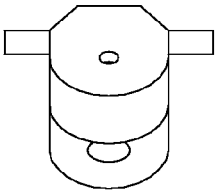
Figure 5E:
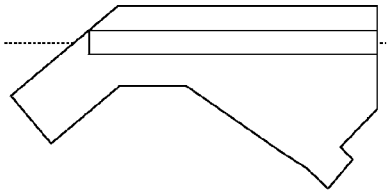
Figure 5F:
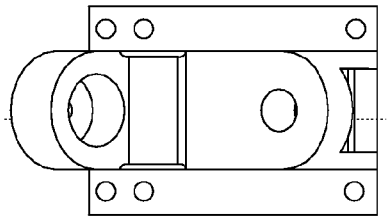
Figure 5G:
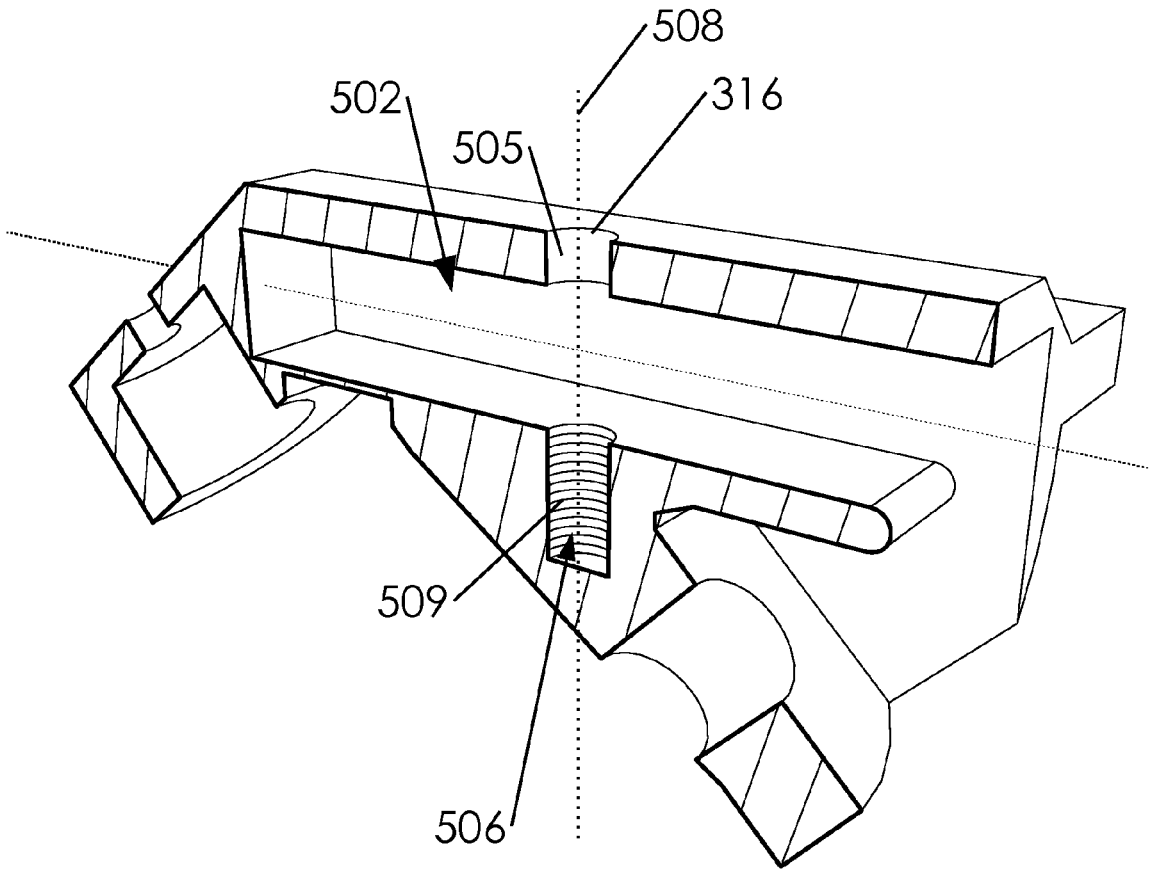
FIG. 5G illustrates a perspective side overview of a cross-section of said base plate.

FIG. 5G illustrates a perspective side overview of a cross-section of said base plate 302. In one embodiment, key socket 502 can comprise a substantially rectangular chamber within said base plate 302. Center aperture 316 can comprise an upper portion 505 and a lower portion 506. In one embodiment, upper portion 505 and lower portion 506 can be aligned on a common axis 508. In one embodiment, lower portion 506 can comprise a female socket having a female threading 509.

FIGS. 6A, 6B, 6C and 6D illustrate a perspective overview, an elevated top view, an elevated first side view, and an elevated front view of L-bracket 304. In one embodiment, said upper portion 320 and lower portion 322 can be substantially perpendicular to one another. In one embodiment, upper portion 320 can comprise a depth 601, a width 602 and a height 603. In one embodiment, lower portion 322 can comprise a width 604 and a height 606. In one embodiment, width 602 can be narrower than width 604. In one embodiment, width 604 of said lower portion 322 can be equal to or less than said width 503 of said key socket 502. In one embodiment, height 606 of said lower portion 322 can be equal to or less than said height 504 of said key socket 502. In one embodiment, L-bracket 304 can comprise a length 607. In one embodiment, a height of said L-bracket 304 can equal said height 603 of said upper portion 320.

In one embodiment, said pairs of sockets of said one or more sockets in said upper portion 320 can be separated vertically by a spacing 605. For example, in one embodiment, said fourth socket 326*d* and said fifth socket 326*e* can be separated by said spacing 605. Likewise, in one embodiment, sixth socket 326*f* and said fifth socket 326*e* can be separated by said spacing 605.*e*

In one embodiment, L-bracket 304 can comprise a rounded edge 608 between lower portion 322 and upper portion 320. In one embodiment, lower portion 322 and upper portion 320 can each comprise a substantially planar portion of L-bracket 304. In one embodiment, lower portion 322 can comprise a tip 609 at a first end of lower portion 322 and said rounded edge 608 at a second end of lower portion 322.

Figure 6A:
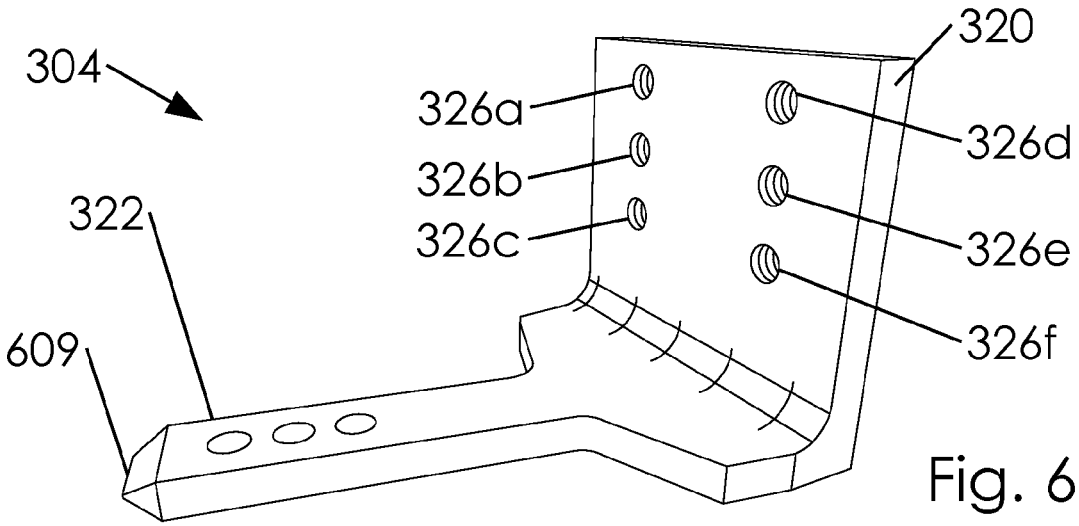
FIGS. 6A, 6B, 6C and 6D illustrate a perspective overview, an elevated top view, an elevated first side view, and an elevated front view of L-bracket.
Figure 6B:
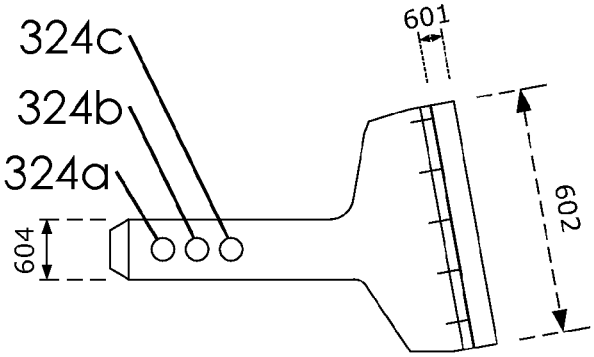
Figure 6C:
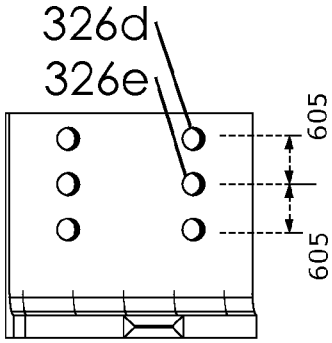
Figure 6D:
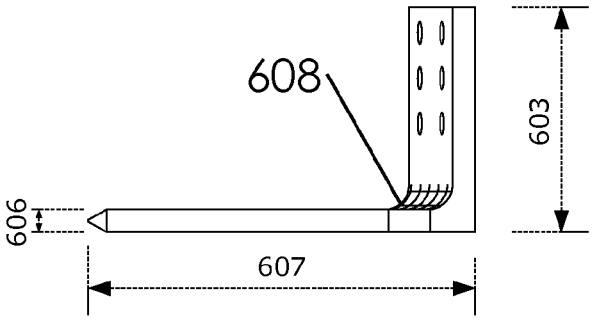
Figure 6E:
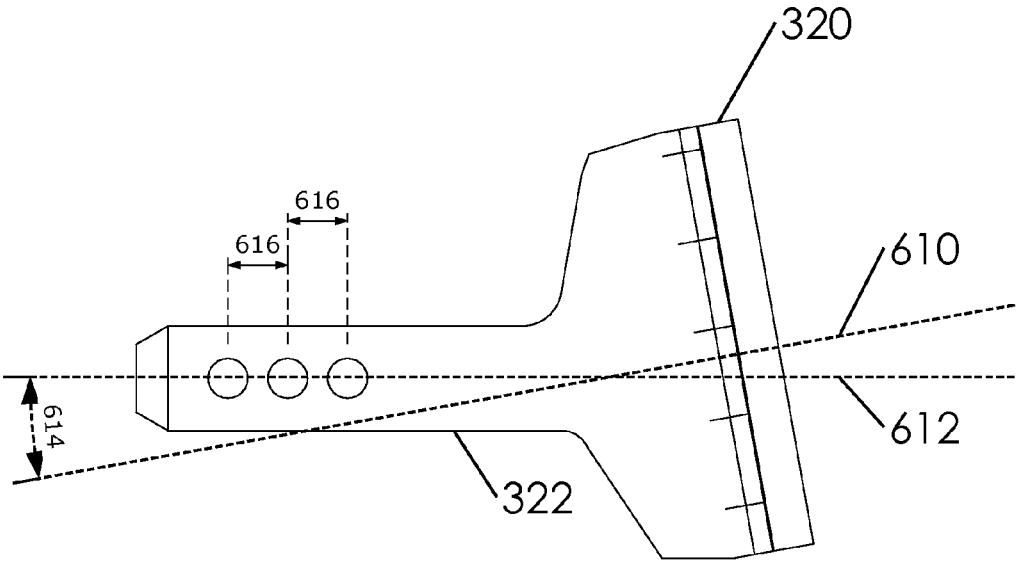
FIG. 6E illustrates an elevated overview of L-bracket.

FIG. 6E illustrates an elevated overview of L-bracket 304. Upper portion 320 can comprise a center axis 610. Lower portion 322 can comprise a center axis 612. In one embodiment, center axis 610 and center axis 612 can be separated by an angle 614. In one embodiment, said angle 614 can allow the feet of said rider 104 to fit under said foot cover 306 at a comfortable position.

In one embodiment, L-bracket 304 can comprise an "L" shaped member of said foot cover assembly 102*a*. In one embodiment, said lower portion 322 can comprise a bottom portion of said "L" shaped member and said upper portion 320 can comprise a top portion of said "L" shaped member. In one embodiment, said lower portion 322 can comprise said tip 609 at said first end of lower portion 322, said substantially planar portion of said lower portion 322 comprising said plurality of sockets, and said width 604 of said lower portion 322 can broaden to said width 602 of said upper portion 320 at said rounded edge 608. In one embodiment, said lower portion 322 and said upper portion 320 can meet and bend at said rounded edge 608. In one embodiment, said upper portion 320 can attach to said lower portion 322 at a first end of said upper portion 320, said one or more sockets in said upper portion 320 can be in said substantially planar portion of said upper portion 320, and a second end of said upper portion 320 can be substantially squared.

In one embodiment, said one or more sockets in said lower portion 322 can be separated along said lower portion 322 by a spacing 616.

FIG. 7A illustrates a perspective first side overview of L-bracket 304 aligned with a cross-section of base plate 302. FIGS. 7B and 7C illustrate a perspective front view and an elevated side view of L-bracket 304 attached to a cross-section of base plate 302. In one embodiment, aligning said L-bracket 304 with said base plate 302 can comprise: aligning said lower portion 322 and said center axis 612 of said key socket 502 on a common axis 702. In one embodiment, attaching said L-bracket 304 to said base plate 302 can comprise: aligning said L-bracket 304 with said key socket 502, inserting a portion of said lower portion 322 into said key socket 502, and securing said lower portion 322 within said key socket 502.

In one embodiment, base plate 302 can adjustably attach to said lower portion 322 of said L-bracket 304. In one embodiment, adjustably attaching said base plate 302 to lower portion 322 can comprise: sliding a portion of lower portion 322 inside of base plate 302, aligning one of said one or more sockets in said lower portion 322 with said center aperture 316, and securing center aperture 316 to said one of said plurality of sockets. In one embodiment, securing center aperture 316 to said one of said one or more sockets in said lower portion 322 can comprise inserting and fixing a screw 704 through said center aperture 316 and said one of said one or more sockets in said lower portion 322. As is common in the art, screw 704 can comprise a male threading 706 and a head 708. In one embodiment, male threading 706 of said screw 704 can attach to said female threading 509 of said lower portion 506. In one embodiment, with said L-bracket 304 attached to said base plate 302, a portion of said L-bracket 304 can extend out of said key socket 502 by an extending distance 710. In one embodiment, adjustably attaching said base plate 302 to said lower portion 322 can comprise selecting one of said one or more sockets in said lower portion 322 so as to adjustably extend and/or adjustably contract said extending distance 710. In one embodiment, inserting said screw 704 through said second socket 324*b* (rather than first socket 324*a*) can increase said extending distance 710 by a length equal to spacing 616.

In one embodiment, inserting and fixing said screw 704 through said center aperture 316 and said one of said one or more sockets in said lower portion 322 can comprise: inserting a portion of said male threading 706 through upper portion 505, then through said one of said one or more sockets in said lower portion 322, and then into said lower portion 506; and rotating said male threading 706 into said female threading 509 to secure said screw 704 into said lower portion 506.

FIGS. 8A, 8B, 8C, 8D and 8E illustrate an elevated top view, front view, first side view, rear view, and second side view of said foot cover 306. As discussed, foot cover 306 can comprise said first portion 328 and said second portion 330. In one embodiment, first portion 328 and second portion 330 can comprise one piece of substantially uniform material. In one embodiment, first portion 328 and second portion 330 can comprise two different materials. Foot cover 306 can comprise a front 802 and a back 804. Foot cover 306 can also comprise a slotted portion 806 and a cover portion 808. Cover portion 808 can comprise a top surface 810 and a bottom surface 812. Cover portion 808 can comprise an edge 814 having a first corner 816 and a second corner 818. In one embodiment, said first corner 816 can be higher than second corner 818; wherein, a nonparallel angle 820 can be between said first corner 816 and second corner 818. Said first corner 816 and slotted portion 806 can be separated by a first height 822. Said second corner 818 and said slotted portion 806 can be separated by a second height 824. In one embodiment, said first height 822 is greater than said second height 824. In one embodiment, first portion 328 can comprise a first side 826. In one embodiment, said first side 826 can comprise a substantially vertical face having said one or more sockets in said foot cover 306 therein. In one embodiment, said one or more sockets in said foot cover 306 can extend entirely through said slotted portion 806.

In one embodiment, a foot of said rider 104 can be held under said foot cover 306. In one embodiment, holding said foot of said rider 104 under said foot cover 306 can comprise pressing said bottom surface 812 of said cover portion 808 of said foot cover 306 into a top portion of said foot of said rider 104.

In one embodiment, foot cover 306 can extend substantially vertically from said slotted portion 806 to said cover portion 808, said cover portion 808 can gradually curve substantially horizontally and perpendicular to said slotted portion 806, and said edge 814 can rotate such that said first height 822 is higher than said second height 824.

FIG. 8F illustrates a perspective lower first side view of said foot cover 306. In one embodiment, said slotted portion 806 of said foot cover 306 can comprise a slot 828 having a length 830 and width 832. In one embodiment, said width 832 of said slot 828 can be greater than or equal to said width 602 of said L-bracket 304. In one embodiment, said length 830 of said slot 828 can be equal to or greater than said depth 601 of said L-bracket 304. In one embodiment, said upper portion 320 of said L-bracket 304 can slide into said slot 828, as discussed infra.

FIGS. 9A and 9B illustrate two perspective overviews of said L-bracket 304 aligned with said foot cover 306. FIG. 9C illustrates a perspective rear view of said L-bracket 304, said foot cover 306 and one or more fasteners. In one embodiment, aligning said L-bracket 304 and said foot cover 306 can comprise: aligning said upper portion 320 of said L-bracket 304 with said slot 828 of said foot cover 306. In one embodiment, attaching said L-bracket 304 to said foot cover 306 can comprise: aligning said L-bracket 304 with said foot cover 306; inserting a portion of said upper portion 320 into said slot 828; aligning one or more of said one or more sockets in said upper portion 320 with said one or more sockets in said foot cover 306; and securing said L-bracket 304 to said foot cover 306 with said one or more fasteners. In one embodiment, said one or more fasteners can comprise a first fastener 902*a* and a second fastener 902*b*.

In one embodiment, securing said L-bracket 304 to said foot cover 306 with said one or more fasteners can comprise: inserting said first fastener 902*a* through said first socket 332*a* and said fifth socket 326*e*; and inserting said second fastener 902*b* through said second socket 332*b* and said second socket 326*b*. In one embodiment, said one or more fasteners can each comprise a screw having a male threading about an external circumference; wherein, said one or more fasteners can attach to said one or more sockets in said foot cover 306 and/or said one or more sockets in said upper portion 320 by screwing into a female threading about an internal circumference of said one or more sockets in said foot cover 306 and/or said one or more sockets in said upper portion 320.

FIGS. 9D and 9E illustrate a perspective overview and an elevated front view of said L-bracket 304 attached to said foot cover 306. In one embodiment, L-bracket 304 attached to foot cover 306 can comprise a height 904.

In one embodiment, L-bracket 304 can adjustably attach to said foot cover 306. In one embodiment, adjustably attaching said L-bracket 304 to said foot cover 306 can comprise altering said height 904 of said L-bracket 304 and foot cover 306 by altering which of said pairs of sockets in said L-bracket 304 to attach to said one or more sockets in said foot cover 306. Thus, in one embodiment, said height 904 can be increased by attaching said one or more sockets in said foot cover 306 to said first socket 326*a* and said fourth socket 326*d* rather than said second socket 326*b* and fifth socket 326*e*. Likewise, in one embodiment, said height 904 can be decreased by attaching said one or more sockets in said foot cover 306 to said third socket 326*c* and said sixth socket 326*f* rather than said second socket 326*b* and said fourth socket 326*d*. Thus, in one embodiment, said foot cover 306 can be adjustably attached to said L-bracket 304.

FIGS. 10A, 10B and 10C illustrate an elevated front view, a perspective overview of second end 212*b* of said board assembly 100, and a perspective overview of first end 212*a* of said foot cover assembly 102 attached to said board assembly 100. Each of said one or more foot cover assemblies can comprise a width 1002 and a height 1004. In one embodiment, adjustably attaching said base plate 302 to said L-bracket 304 can selectively adjust said width 1002 of said one or more foot cover assemblies. In one embodiment, adjustably attaching said L-bracket 304 to said foot cover 306 can selectively adjust said height 1004 of said width 1002.

In one embodiment, said L-bracket 304 and said foot cover 306 can be removed from one or more of said one or more foot cover assemblies in order to facilitate riding said board assembly 100 in a traditional fashion (i.e., lacking said one or more foot covers).

In one embodiment, a method using said foot cover assembly 102*a* can comprise adjusting a width 1002 and/or a height 1004. In one embodiment, adjusting said width 1002 can comprise adjustably attaching said L-bracket 304 to said base plate 302. In one embodiment, adjusting said height 1004 can comprise adjustably attaching said foot cover 306 to said L-bracket 304 by detaching said foot cover 306 from said L-bracket 304, adjusting an alignment of said foot cover 306 and said L-bracket 304 to a desired height, and attaching said L-bracket 304 to said foot cover 306 once again.

In one embodiment, said method of using said foot cover assembly 102*a* can comprise removably attaching a foot cover 306 to a truck assembly. In one embodiment, removably attaching said foot cover 306 from said truck assembly can comprise: attaching said foot cover 306 to said L-bracket 304, and removing said foot cover 306 from said L-bracket 304.

In one embodiment, said base plate 302 can comprise an upper portion 1006*a* and a lower portion 1006*b*. In one embodiment, with said base plate 302 attached to said deck 200, said upper portion 1006*a* can extend above said deck 200 and said lower portion 1006*b* can extend below said deck 200. Accordingly, said wheel assembly 402 can attach to said lower portion 1006*b* of said base plate 302, and said foot cover 306 and said L-bracket 304 can attach to said upper portion 1006*a* of said base plate 302.

FIG. 11 illustrates a perspective overview of a board assembly 1100. In one embodiment, said board assembly 1100 can comprise a foot cover assembly 1102*a*, a foot cover assembly 1102*b* and a deck 1104. In one embodiment, said foot cover assembly 1102*a* and said foot cover assembly 1102*b* can be substantially similar to one another but-for being mirror images of one another, as discussed and illustrated herein. In one embodiment, said foot cover assembly 1102*a* can be attached to a first end 1106*a* and said foot cover assembly 1102*b* can be attached to a second end 1106*b* of said deck 1104. In one embodiment, said foot cover assembly 1102*a* and said foot cover assembly 1102*b* can be referred to and described herein as being substantially identical to said foot cover assembly 1102*a*. In one embodiment, said foot cover assembly 1102*a* can be substantially similar to said foot cover assembly 102*a*, except that said deck 200 can be a drop-through deck and said deck 1104 can lack said first drop-through cutout 202*a* and/or said second drop-through cutout 202*b*; that is, said deck 1104 can comprise a solid deck. Wherein, said two wheel assemblies attach to a bottom side of said deck 1104, and said foot cover assembly 1102*a* and/or said foot cover assembly 1102*b* attach to a top side of said deck 1104. In one embodiment, one end of said deck 1104 may have a first drop-through cutout 202*a* using said adjustable binding system 300 and another end of said 1104 may be solid and use said foot cover assembly 1102*a*.

FIG. 12 illustrates a perspective overview of said foot cover assembly 1102*a*. In one embodiment, said foot cover assembly 1102*a* and/or said foot cover assembly 1102*b* can comprise a foot cover 1202, an L-bracket 1204, and a base plate 1206. In one embodiment, said foot cover 1202 can comprise a second portion 1210 and a first portion 1212. In one embodiment, said second portion 1210 can cover up said foot 120 of said rider 104. In one embodiment, said first portion 1212 can selectively attach to said L-bracket 1204, as discussed above. In one embodiment, said first portion 1212 can comprise a first upper socket 1214*a*, a second upper socket 1214*b*, a first lower socket 1216*a* and a second lower socket 1216*b*. In one embodiment, a first screw 1218*a* and a second screw 1218*b* can selectively attach said L-bracket 1204 to said first portion 1212, as illustrated. In one embodiment, said base plate 1206 can selectively attach to said L-bracket 1204.

FIGS. 13A, 13B and 13C illustrate an elevated overview, elevated front view and an elevated top view of said L-bracket 1204. In one embodiment, said L-bracket 1204 can comprise a lower portion 1302 and an upper portion 1304; wherein, said lower portion 1302 can comprise a substantially horizontal portion of said L-bracket 1204 and said upper portion 1304 can comprise a substantially vertical portion of said L-bracket 1204. In one embodiment, said upper portion 1304 can comprise a plurality of sockets which can comprise a first socket 1306*a*, a second socket 1306*b*, a third socket 1306*c*, a fourth socket 1306*d*, a fifth socket 1306*e*, a sixth socket 1306*f*, a seventh socket 1306*g*, an eighth socket 1306*h*, a ninth socket 1306*k*, and a tenth socket 1306*m*. In one embodiment, said 1306*a* through 1306*e* can be aligned on a first side 1310 and said 1306*f* through said 1306*m* on a second side 1312 of said upper portion 1304. In one embodiment, said upper portion 1304 can attach to said lower portion 1302 at an elbow 1314. In one embodiment, said lower portion 1302 can comprise a plurality of sockets which can comprise a first socket 1310*a*, a second socket 1310*b*, and a third socket 1310*c*.

FIGS. 14A and 14B illustrate a perspective overview and lower view of said base plate 1206. In one embodiment, said base plate 1206 can comprise a plurality of sockets which can comprise a first socket 1403*a*, a second socket 1403*b*, a third socket 1403*c*, a fourth socket 1403*d*, a fifth socket 1403*e*, and a sixth socket 1403*f* In one embodiment, said base plate 1206 can comprise a top side 1402, a bottom side 1404, an indention 1406, a first side 1408, and a second side 1410. In one embodiment, said 1403*a* through said 1403*c* are aligned on said second side 1410, and said 1403*d* through said 1403*f* are aligned on said first side 1408. In one embodiment, said indention 1406 allow said base plate 1206 to attach to an industry standard truck on one of said board assembly 1100.

FIGS. 15A and 15B illustrate a perspective overview and a lower view of said foot cover 1202. In one embodiment, said first portion 1212 can comprise a slot 1502. In one embodiment, a portion of said upper portion 1304 can slide into said slot 1502.

FIGS. 16A and 16B illustrate two perspective overviews of said foot cover assembly 1102*a* attached to said deck 1104. In one embodiment, said L-bracket 1204 can selectively attach to said base plate 1206 so as to have a variable width 1602, and said foot cover 1202 can selectively attach to said L-bracket 1204 so as to have a variable height 1604.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A foot cover assembly comprising:
a foot cover and a base plate;
said foot cover releaseably attaches to said base plate;
said base plate releaseably attaches to a board assembly;
a portion of said foot cover is arranged over a deck of said board assembly;
said foot cover selectively holds a foot of a rider of said board assembly between said foot cover and said deck;
said base plate releaseably attaches to said deck;
said board assembly comprises at least a two wheel assemblies comprising a first wheel assembly and a second wheel assembly;
at least one of said two wheel assemblies releaseably attach to a lower portion of said base plate below said deck;
said foot cover releaseably attaches to an upper portion of said base plate above said deck;
said deck comprises at least a first drop-through cutout;
said lower portion of said base plate slides through said first drop-through cutout of said deck and extends below said deck; and
said upper portion of said base plate above said deck attaches above said deck and does not pass through said first drop-through cutout.

2. A foot cover assembly comprising:
a foot cover and a base plate;
said foot cover releaseably attaches to said base plate;
said base plate releaseably attaches to a board assembly;
a portion of said foot cover is arranged over a deck of said board assembly;
said foot cover selectively holds a foot of a rider of said board assembly between said foot cover and said deck;
an L-bracket having an upper portion and a lower portion; wherein
said foot cover assembly comprises a width and a height;
said lower portion of said L-bracket releaseably attaches to said base plate;
said upper portion of said L-bracket releaseably attaches to said foot cover;
further comprising a one or more fasteners; wherein,
said L-bracket comprises one or more sockets in said upper portion;
said foot cover comprises a one or more sockets;
said foot cover releaseably attaches to said L-bracket by
aligning said one or more sockets in said upper portion with one or more of said one or more sockets in said foot cover,
attaching said upper portion to said foot cover with said one or more fasteners; and,
said height of said foot cover assembly is adjusted by
detaching said one or more fasteners holding said L-bracket to said foot cover,
adjusting an alignment of said one or more sockets in said upper portion with said one or more sockets in said foot cover; and
attaching said L-bracket to said foot cover.

3. The foot cover assembly of claim 2, wherein
said base plate releaseably attaches to said deck;
said board assembly comprises at least a two wheel assemblies comprising a first wheel assembly and a second wheel assembly;
at least one of said two wheel assemblies releaseably attach to a lower portion of said base plate below said deck; and
said foot cover releaseably attaches to an upper portion of said base plate above said deck.

4. The foot cover assembly of claim 3, wherein
said deck comprises at least a first drop-through cutout;
said lower portion of said base plate slides through said first drop-through cutout of said deck and extends below said deck; and
said upper portion of said base plate above said deck attaches above said deck and does not pass through said first drop-through cutout.

5. The foot cover assembly of claim 2, wherein
said foot cover comprises a slotted portion and a cover portion;
said slotted portion of said foot cover comprises a slot having a width and a length;
said slot selectively receives a portion of said upper portion of said L-bracket;
said width of said slot is at least equal to said width of said L-bracket; and
attaching said foot cover to said L-bracket comprises
aligning said upper portion of said L-bracket with said slot of said foot cover,
inserting a portion of said upper portion of said L-bracket into said slot of said foot cover, and attaching said upper portion of said L-bracket to said foot cover.

6. The foot cover assembly of claim 5, wherein said slotted portion of said foot cover comprises one or more sockets in said foot cover;

said one or more sockets in said foot cover each cross through said slot in said slotted portion of said foot cover; and attaching said upper portion of said L-bracket to said foot cover further comprises:

aligning one or more of said one or more sockets in said upper portion with said one or more sockets in said foot cover, and attaching said foot cover to said L-bracket with said one or more fasteners.

7. The foot cover assembly of claim 2, further comprising a one or more fasteners; wherein, said L-bracket comprises one or more sockets in said upper portion;

said foot cover comprises a one or more sockets;

said one or more sockets in said foot cover comprise a female threading; and said one or more fasteners each comprise a male threading; further, wherein attaching said one or more sockets in said foot cover to said one or more sockets in said upper portion comprises:

inserting said one or more fasteners through said one or more sockets in said upper portion and said one or more sockets in said foot cover.

8. The foot cover assembly of claim 7, wherein said base plate comprises a center aperture having an upper portion and a lower portion;

said lower portion of said center aperture comprises a female threading;

said one or more fasteners each comprise a screw having a male threading; and securing said center aperture to one of said one or more sockets in said lower portion of said L-bracket comprises:

inserting said screw through said upper portion of said center aperture, one of said one or more sockets in said lower portion of L-bracket, and said lower portion of said center aperture; and fixing said screw into said lower portion of said center aperture by screwing said male threading into said female threading.

9. The foot cover assembly of claim 2 wherein said base plate comprises one or more side apertures in a one or more side portions; and said side apertures releaseably attach to a plurality of sockets in said deck with one or more screw assemblies.

10. The foot cover assembly of claim 2, wherein said deck does not comprise a two drop-through cutouts and is instead a solid deck;

said base plate releaseably attaches to a top side of said deck; and said at least a two wheel assemblies attach to a bottom side of said deck.

11. A method of using a foot cover assembly comprising:

releaseably attaching a base plate of a foot cover assembly to a foot cover of said foot cover assembly;

attaching said foot cover assembly to a deck;

attaching a wheel assembly to said base plate;

holding a foot of a rider between said deck and said foot cover;

wherein releaseably attaching said base plate to said foot cover comprises:

attaching a lower portion of an L-bracket of said foot cover assembly to said base plate and attaching an upper portion of said L-bracket to said foot cover;

attaching said foot cover to said L-bracket comprises aligning and attaching a one or more sockets in said upper portion with a one or more sockets in said foot cover using one or more fasteners; and adjusting a height of said foot cover assembly comprises detaching said one or more fasteners holding said L-bracket to said foot cover, and aligning and attaching said one or more sockets in said foot cover with one or more different sockets among said one or more sockets in said upper portion with said one or more fasteners.

12. A method of using a foot cover assembly of claim 11 wherein attaching said foot cover to said l-bracket comprises:

aligning said upper portion of said L-bracket with a slot of said foot cover, inserting a portion of said upper portion of said L-bracket into said slot of said foot cover, and attaching said upper portion of said L-bracket to said foot cover.

13. A method of using a foot cover assembly of claim 12, wherein attaching said upper portion of said L-bracket to said foot cover further comprises:

aligning one or more of said one or more sockets in said upper portion with sockets in said foot cover, and attaching said foot cover to said L-bracket with said one or more fasteners; and, said one or more sockets in said foot cover each cross through said slot in a slotted portion of said foot cover.

14. A method of using a foot cover assembly of claim 11 wherein attaching said one or more sockets in said foot cover to said one or more sockets in said upper portion comprises inserting one or more fasteners through said one or more sockets in said upper portion and said one or more sockets in said foot cover; further, wherein said one or more sockets in said foot cover comprise a female threading, and said one or more fasteners each comprise a male threading.

15. A foot cover assembly comprising:

a foot cover and a base plate;

said foot cover releaseably attaches to said base plate;

said base plate releaseably attaches to a board assembly;

a portion of said foot cover is arranged over a deck of said board assembly;

said foot cover selectively holds a foot of a rider of said board assembly between said foot cover and said deck;

an L-bracket having an upper portion and a lower portion; wherein said foot cover assembly comprises a width and a height;

said lower portion of said L-bracket releaseably attaches to said base plate;

said upper portion of said L-bracket releaseably attaches to said foot cover;

further comprising a one or more fasteners; wherein, said L-bracket comprises one or more sockets in said upper portion;

said foot cover comprises a one or more sockets;

said one or more sockets in said foot cover comprise a female threading;

said one or more fasteners each comprise a male threading; and further, wherein attaching said one or more sockets in said foot cover to said one or more sockets in said upper portion comprises:

inserting said one or more fasteners through said one or more sockets in said upper portion and said one or more sockets in said foot cover.

* * * * *